US012390710B2

(12) United States Patent
Sand et al.

(10) Patent No.: US 12,390,710 B2
(45) Date of Patent: Aug. 19, 2025

(54) BATTING DEVICE

(71) Applicant: May We Help, Cincinnati, OH (US)

(72) Inventors: William Sand, Cincinnati, OH (US); Raphael J. Riley, Lebanon, OH (US)

(73) Assignee: May We Help, Cincinnati, OH (US)

( * ) Notice: Subject to any disclaimer, the term of this patent is extended or adjusted under 35 U.S.C. 154(b) by 441 days.

(21) Appl. No.: 18/077,820

(22) Filed: Dec. 8, 2022

(65) Prior Publication Data

US 2024/0189694 A1 Jun. 13, 2024

(51) Int. Cl.

| | |
|---|---|
| ***A63B 71/00*** | (2006.01) |
| ***A63B 69/00*** | (2006.01) |
| *A63B 102/18* | (2015.01) |

(52) U.S. Cl.

CPC ..... *A63B 71/0009* (2013.01); *A63B 69/0075* (2013.01); *A63B 2102/18* (2015.10); *A63B 2225/093* (2013.01)

(58) Field of Classification Search

CPC ..... A63B 71/0009; A63B 69/0075; A63B 2102/18; A63B 2225/093

USPC ..... 473/417

See application file for complete search history.

(56) References Cited

U.S. PATENT DOCUMENTS

| | | | | |
|---|---|---|---|---|
| 2,008,052 A * | 7/1935 | Walker | A63F 7/0608 | 273/317.7 |
| 5,201,520 A * | 4/1993 | Castle | A63F 7/0608 | 273/317.9 |
| 5,988,861 A * | 11/1999 | Baum | A63B 24/0021 | 73/12.02 |
| 6,322,461 B1 * | 11/2001 | Walsh | A63B 63/06 | 473/422 |
| 10,874,924 B2 * | 12/2020 | Walton | A63B 69/0002 | 473/417 |

* cited by examiner

*Primary Examiner* — Mitra Aryanpour
(74) *Attorney, Agent, or Firm* — Frost Brown Todd LLP

(57) ABSTRACT

A batting device includes a housing, a rotating assembly, an actuating assembly, and a swinging assembly. The rotating assembly includes a rotational member positioned within the housing and a resilient member that exhibits rotational force upon the rotating assembly. The actuating assembly includes a firing device that a user acts upon to transition the rotating assembly from a first state of rest to a second state of rotational movement. The swinging assembly retains a bat and is fixedly coupled to the rotating assembly and rotates with the rotating assembly to swing the bat when the user acts upon the firing device to transition the rotating assembly from the first state to the second state.

20 Claims, 18 Drawing Sheets

BATTING DEVICE

BACKGROUND

Not all people are physically capable of wielding a bat to hit a ball due to a physical disability. Batting systems are configured to help disabled people who cannot hold and swing a bat to hit a ball from a ball holder otherwise known as a tee with a batting device. Batting systems must be stable while being used, but mobile enough to be transported to a baseball field. Additionally, the batting device must also be quickly removed from the home plate to allow baserunners to access home plate after the ball is hit into play. While various types of handicap aids have been made and used, it is believed that no one prior to the inventors has made or used the invention described herein.

BRIEF DESCRIPTION OF THE DRAWINGS

The accompanying drawings, which are incorporated in and constitute a part of this specification, illustrate embodiments of the invention, and, together with the general description of the invention given above, and the detailed description of the embodiments given below, serve to explain the principles of the present invention.

Figure 1:
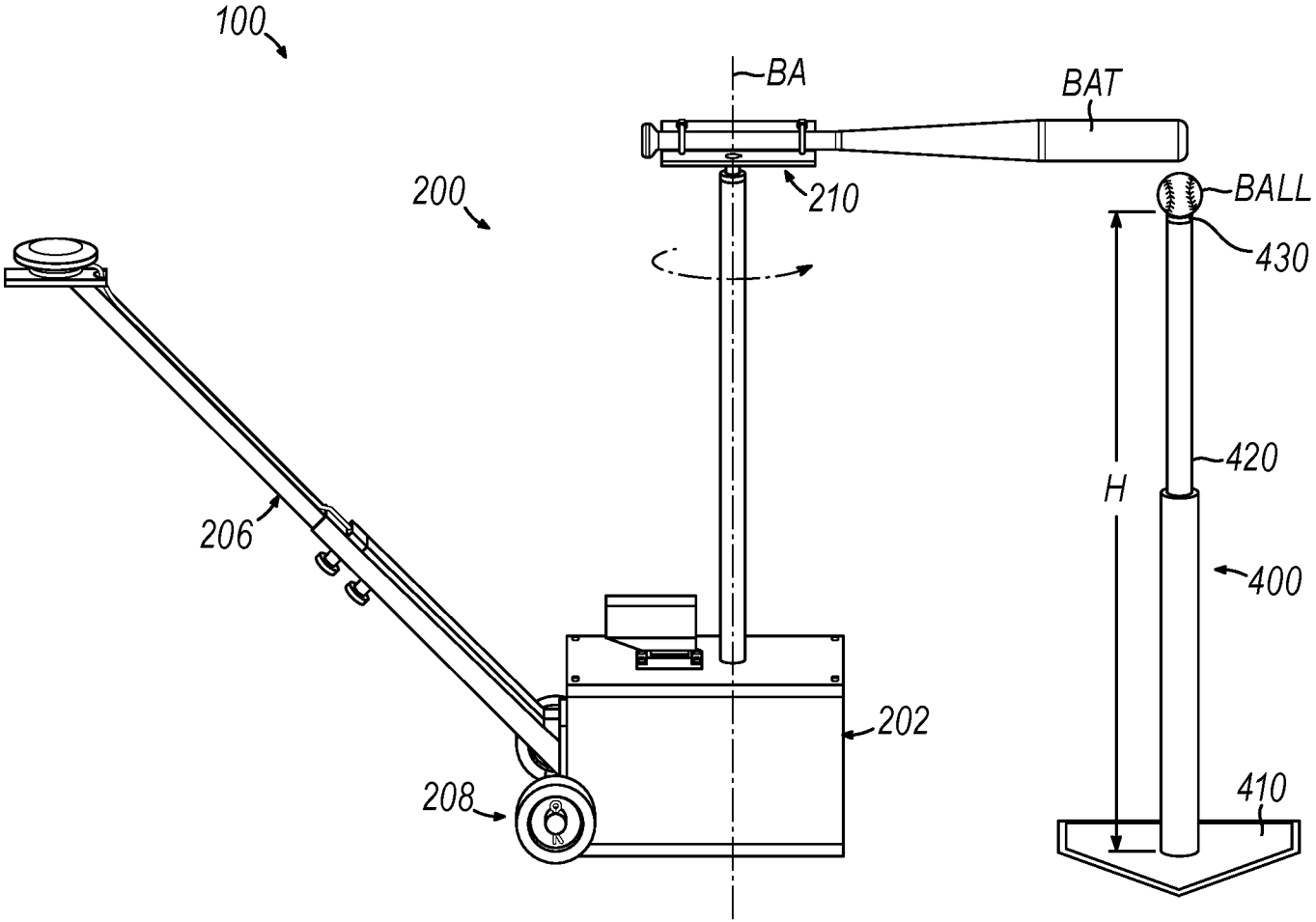
FIG. 1 shows a side perspective view of a batting system including a batting device, ball holder, and ball.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

For clarity of disclosure, the terms "proximal" and "distal" are defined herein relative to a user (e.g., a batter). The term "proximal" refers to the position of an element arranged closer to the user, and the term "distal" refers to the position of an element arranged further away from the user. To the extent that spatial terms such as "top," "bottom," "upper," "lower," "vertical," "horizontal," or the like are used herein with reference to the drawings, it will be appreciated that such terms are used for exemplary description purposes only and are not intended to be limiting or absolute. In that regard, it will be devices such as those disclosed herein may be used in a variety of orientations and positions not limited to those shown and described herein.

Furthermore, the terms "about," "approximately," and the like as used herein in connection with any numerical values or ranges of values are intended to encompass the exact value(s) referenced as well as a suitable tolerance that enables the referenced feature or combination of features to function for the intended purpose described herein.

I. EXEMPLARY ELECTRICALLY ACTUATED BATTING DEVICE

In some instances, it may be desirable to provide a batting device that enables a person with limited motor function to hit a ball with a bat from a ball holder. Such a device must be stationary and stable when in operation so the device may transfer energy to the ball to enable the ball to be hit into play at an acceptable distance. The device must also be portable so that the device may be easily transported to a sports field but be capable of being quickly moved so the batting device does not interfere with baserunners. The batting device described below in connection with the Figures exhibit such features and functionality.

FIG. 1 shows a batting system (100) including a batting device (200) and a ball holder (400). The batting device (200) is capable of swinging a bat (BAT) about a batting axis (BA) at a height (h) that corresponds with the height (h) of a ball (BALL) positioned upon a ball holder (400). The batting device (200) comprises a housing assembly (202) best shown in FIGS. 3A-3C, a rotating assembly (204) best shown in FIGS. 3A-3C, a handle assembly (206) best shown in FIGS. 4A-4B, an axle assembly (208) best shown in FIGS. 5-6B, a swinging assembly (210) best shown in FIG. 7, and an actuating assembly (212) best shown in FIG. 2.

Ball holder (400) or tee may be of the fixed variety that can only be used with the height (h) or may be adjustable so that the ball holder (400) may be used for users utilizing batting device (200) and users of different physically stature swinging bat (BAT) at the ball (BALL) without batting device (200). The ball holder (400) includes a holder base (410) having a planar surface configured to provide stability and engage the earth and a ball support (420) including tubular in shape and extending vertically away from holder base (410). Ball support (420) may additionally have a ball mount (430) that includes a flared surface configured to retain the ball (BALL) upon ball support (420). Ball support (420) or ball mount (430) may be constructed of materials that have resilient properties to prevent ball holder (400) from being knocked over when struck with a bat (BAT). The batting system (100) may be adapted to be used to hit a ball (BALL) in the game of baseball, but may be adapted for similar sports where a bat is used to hit a ball such as softball, stickball, T-ball, wiffle ball, cricket, or any similar sport that uses a bat (BAT) to hit a ball (BALL) that is apparent to those of ordinary skill in the art. These are merely examples of sports where a bat is used to hit a ball and is not intended to be unnecessarily limiting. The ball (BALL) may include any ball (BALL) that corresponds to the sport being played.

Figure 2:
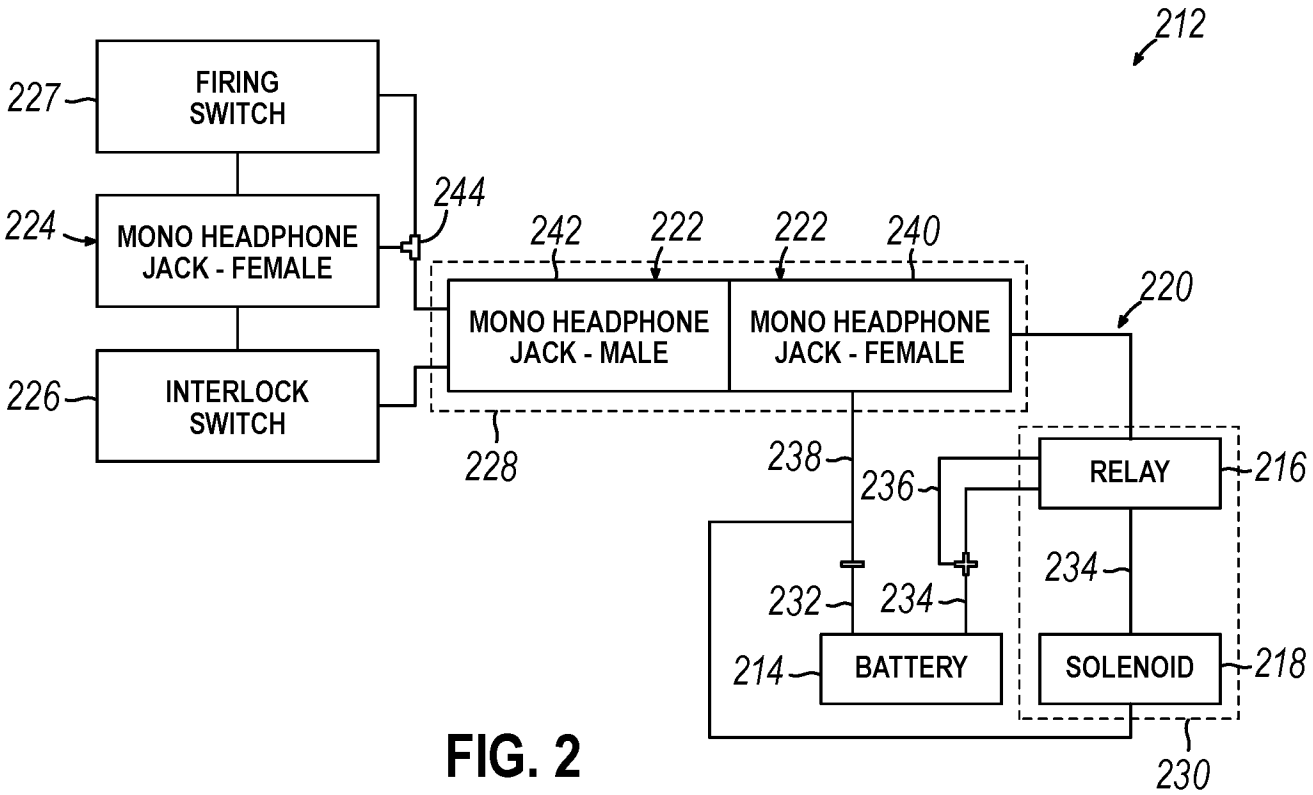
FIG. 2 shows a schematic diagram of the actuating assembly of the batting device of FIG. 1.

FIG. 2 shows the actuation assembly (212) that enables the user to swing a bat with the push of a button. The actuation assembly (212) includes a power source (214), a relay (216), a solenoid (218), a wiring harness (220), a first wiring connector (222), a second wiring connector (224), an interlock switch (226), and a firing switch (227). The power source (214) includes a battery that stores energy that may be used to activate the solenoid (218) or actuator. The power source (214) is connected via the wiring harness (220) to the solenoid (218). The wiring harness (220) includes a control circuit (228) and an operational circuit (230). The operational circuit (230) may include larger cables than the control circuit (228). The larger cables provide sufficient capacity to facilitate enough current to actuate the solenoid (218). The control circuit (228) does not require a lot of current to actuate the relay and allows for a relatively less robust firing switch (227), than if no control circuit (228) was used. The control circuit (228) may use a different voltage and current than the operating circuit (230). Firing switch (227) may be used interchangeably with firing device. The operational circuit (230) includes a negative operational cable (232) and a positive operational cable (234). The negative operational cable (232) extends directly from the battery (214) to the solenoid (218). The positive operational cable (232) connects to the relay (216) and further extends from the relay (216) to the solenoid (218).

The relay (216) links the control circuit (228) to the operational circuit (230) and allows the operational circuit (230) to be actuated by the control circuit (228). The relay (216) includes an electromagnetic coil (not shown) and one or more contacts (not shown). The contact has a first side (not shown) and a second side (not shown). The positive control cable (236) connects to the positive side of the electromagnetic coil and the negative control cable (238) connects to the negative side of the electromagnetic coil. When the control circuit (228) is completed, the electromagnetic coil pulls the contacts in bridging the first and second sides of the contact completing the operational circuit (230) and providing voltage to the solenoid (218).

The control circuit (228) includes the negative control cable (238) that extends from the battery (214) to the first wiring connector (222). The first wiring connector (222) divides the control circuit (228) into an upper and lower wiring assembly. The first wiring connector includes a male portion (240) and a female portion (242) that are connected in order to complete the control circuit (228). The first and second wiring connectors (222, 224) may be mono headphone jacks. In the present version, the female portion (240) is more proximate to the battery (214) than the male portion (242) but this may be reversed and the male portion (242) may be more proximate to the battery than the female portion (240). The negative control cable (238) extends to the interlock switch (226) that is wired in series with the firing switch (227) and the second wiring connector (224). The interlock switch (226) is a normally open, momentary interlock switch (226). The interlock switch (226) must be pressed into a closed position by a batting assistant or other operator to complete the control circuit (228) so that the firing switch (227) may be closed to complete the control circuit (228). The interlock switch (226) provides a layer of safety to the batting process that is within the control of the batting assistant. The batting assistant is able to break the control circuit (228) until it is safe for a user to activate the solenoid (218), and thereby swing the bat (BAT). The negative control cable (238) extends further to a T-connection (244).

The T-connection (244) is permanently connected to a second wiring connector (224). The second wiring connector (224) allows an alternate firing switch (227) to be used to complete the control circuit (228) and activate the solenoid (218). Not all people have the physical ability to close the firing switch (227) with a hand. The second wiring connector (224) through the T-connection (224) is wired in parallel with the firing switch (227) and allows the firing switch (227) to be wired in parallel with an alternate switch (not shown). The alternate switch may be used by a user to complete the control circuit (228) without the firing switch (227) being closed. The alternate switch may be a mouth switch (not shown), a foot switch (not shown), or a switch configured to be depressed by another part of the body. The mouth and foot switches are configured to be depressed by the mouth or foot of a user.

The negative control cable (238) extends from the T-connection (244) to the firing switch (227). The firing switch (227) may be a jellybean switch. The firing switch (227) is a normally open switch that includes sufficient surface area to aid a user having minimal dexterity to closing the firing switch (227). The negative control cable (238) further extends through the first wiring connector (222) to the relay (216). The negative control cable (238) connects to the negative side of the electromagnetic coil.

In order to activate the solenoid (218) a batting assistant must close the interlock switch (226). Then, the user closes the firing switch (227) or the alternate switch completing the control circuit (228). The completed control circuit (228) energizes the electromagnetic coil in the relay (216). The electromagnetic coil closes the contact. With the closed contact, electricity may pass through the relay (216) and operating circuit (230) to energize the solenoid (218).

Figure 3A:
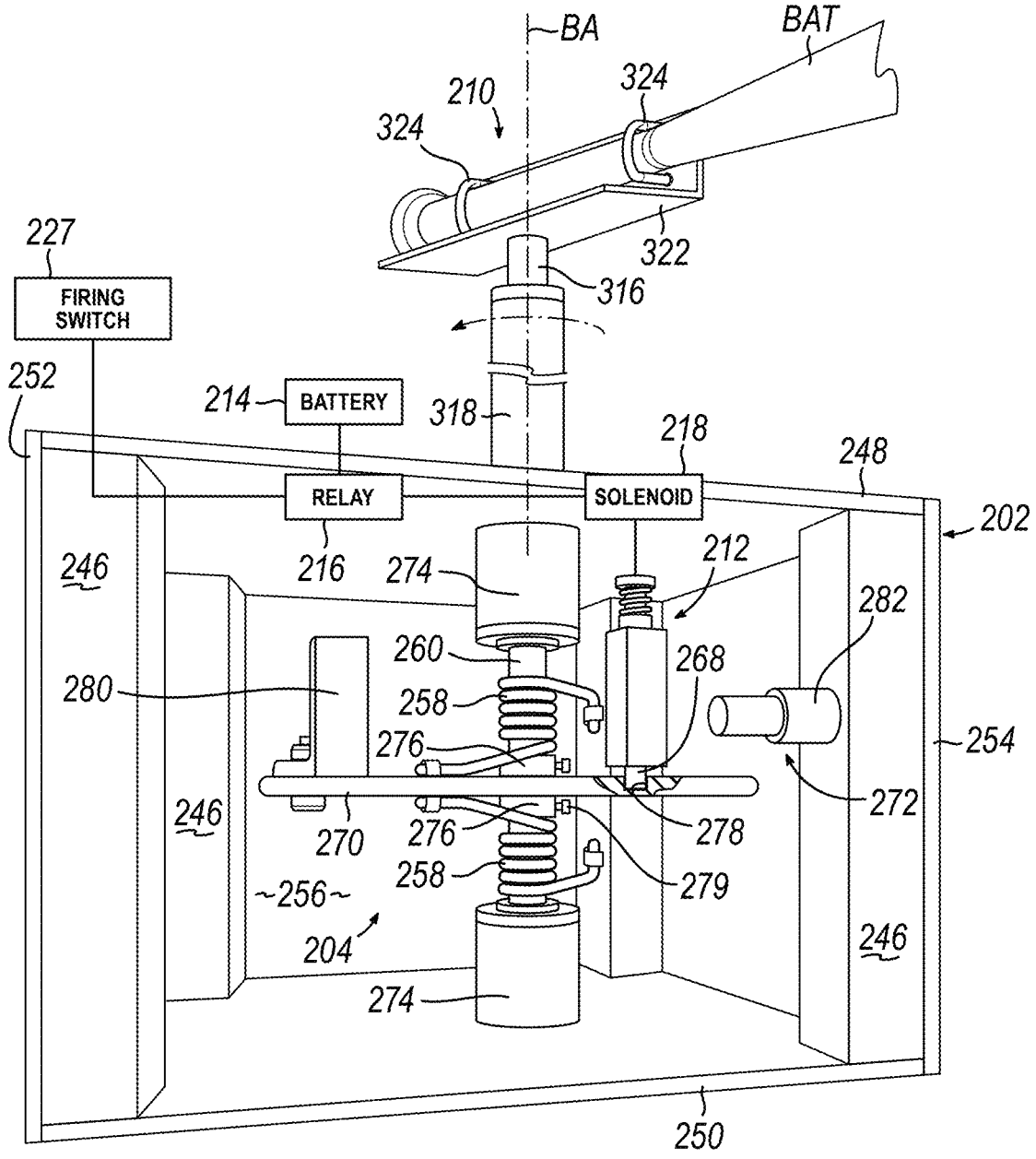
FIG. 3A shows a side perspective view of the batting device of FIG. 1 in the armed position.
Figure 3B:
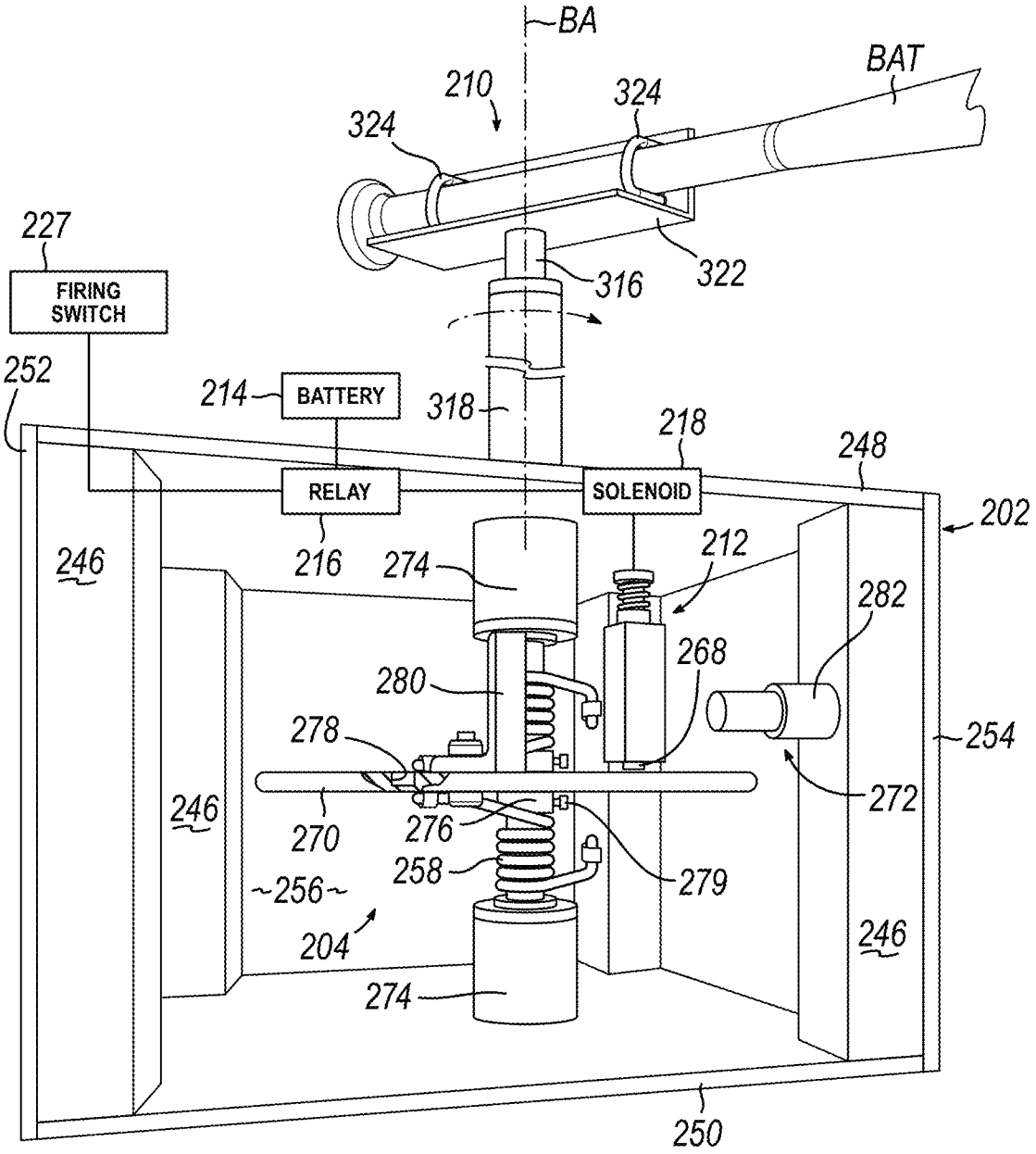
FIG. 3B shows a side perspective view of the batting device of FIG. 1 transiting from the armed position to the disarmed position.
Figure 3C:
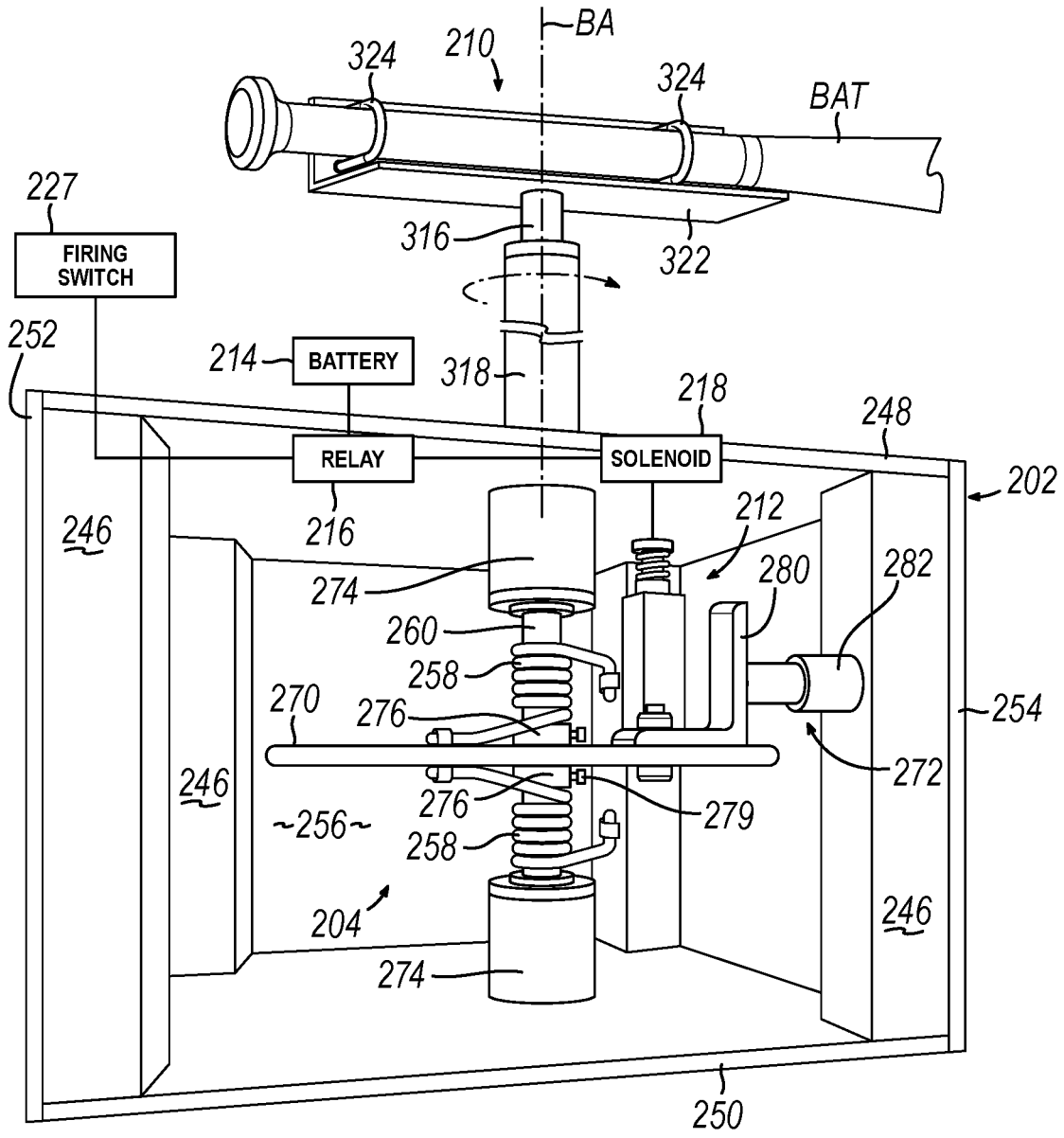
FIG. 3C shows a side perspective view of the batting device of FIG. 1 being transitioned from the disarmed position to the armed position.

FIG. 3A-3C shows the batting device (200) in a stationary configuration with the axle assembly (208) configured to not engage the ground and the batting device (200) being actuated with minimal physical input to rotate the rotating assembly (204) within the housing (202), which in turn rotates the swinging assembly (210) thereby hitting a ball (BALL) from ball holder (400). Housing is synonymous with the term base. When the bat (BAT) swings with enough force to hit ball (BALL) to an acceptable distance in the normal play of the designated sport such as baseball.

Housing assembly (202) includes a rectangular shape but may be configured as any other shape such as a cylindrical shape, a polygon shape, a pyramid shape, a conical shape, or any other shape known to those skilled in the art to have a stable base. The housing assembly (202) includes a frame (246) and multiple panels (248, 250, 252, 254) that together enclosing an interior (256) of the housing assembly (202). The housing assembly (202) in the present version is rectangular and includes a top panel (248) positioned distal of the ground; a bottom panel (250) positioned proximate to the ground; a pair of side panels (not shown) extending between the top panel (248) and the bottom panel (250) along the length of the housing assembly (202); a front panel (254) extending between the top and bottom panels (248, 250); and a back panel (252) extending between the top and bottom panels (248, 250) on a side opposite the front panel (254). Handle assembly (206) operatively attached to frame (246) and extends at an angle from the back panel (252). The axle assembly (208) is also attached to the back panel (252) and is configured to transition the batting device (200) from a mobile configuration to a stationary configuration. The rotating assembly (204) is rotatably positioned within the interior (256) of the housing assembly (202). The housing assembly (202) acts as a mechanical ground for the rotating assembly (204). The swinging assembly (210) is fixedly coupled to the top panel (248) and is affixed to and configured to rotate with the rotating assembly (204).

FIG. 3A shows the rotating assembly (204) in the first position before being fired by the actuating assembly (212). The rotating assembly (204) includes at least one spring (258), a shaft (260), a flywheel (270), a stopping assembly (272), a pair of bearings (not shown), and a pair of bearing retainers (274). The rotating assembly (240) is attached to the frame (246) by a pair of bearing retainers (274). Each of the bearing retainers (274) (247) is constructed of a hollow tube welded to the top and bottom panels (248, 250). In the alternative these bearing retainers (274) may be welded to a top and bottom portion of the frame (246). The bearing retainers (274) are positioned so that the shaft (260) is oriented vertically. The bearings may include roller bearings (not shown) or sleeve bearings (not shown). In versions including roller bearings, the shaft (260) is press fit within the bearings. The shaft (260) is fixed within the inner race of the roller bearing and rotates with the inner race that is separated from the outer race by balls or rollers. In versions with sleeve bearings, the sleeve bearings are press fit within the bearing retainers (274) and the shaft (260) is sized to rotate freely within the sleeve bearing. The flywheel (270) or other rotational member is positioned between the two bearing retainers (274) and is vertically located by one or more collars (276) that are welded to the flywheel (270). The collars (276) include a set screw (279) configured to position the flywheel (270) along the shaft (260). The flywheel (270) includes an aperture (not shown) configured to mate with a solenoid shaft (268) when the solenoid (218) is not powered by the actuating assembly (212) in the first position.

The at least one spring (258) includes a pair of tortional springs. Each spring (258) is secured to the bearing retainers (274) at a first end and each spring (258) is secured to the flywheel (270) at a second end. In the first position, the spring (258) is biased to rotate the flywheel (270) in a counterclockwise direction when viewed from the top, and provide force upon the solenoid shaft (268) until the solenoid shaft (268) is retracted by firing of the actuation assembly (212).

FIG. 3B shows the batting device (200) after being fired by the actuation assembly (212) and transitioning the rotating assembly (204) from the first position towards the second position. The actuation assembly (212) retracts the solenoid shaft (268) of the solenoid (218) from an aperture (278) located in the flywheel (270) releasing the flywheel (270) allowing the flywheel (270), held under tension of the springs (258), to rotate in the counter-clockwise direction. The rotating assembly (204) being attached to the swinging assembly (210) or bat retaining member that rotates the swinging assembly (210) and swings the bat (BAT) at a ball (BALL).

FIG. 3C shows the batting device (200) being transitioned from the first position to the second position. The stopping assembly (272) engages the flywheel (270) to prevent the rotating assembly (204) from further rotating the swinging assembly (210) thereby stopping the bat (BAT). Having a set stopping point improves the safety and expectations of the users where the bat (BAT) will come to rest.

The stopping assembly (272) includes a stopping member (280) and a resilient stopper (282). The stopping member (280) is fixedly secured to an outer portion of the flywheel (270) and extends vertically away from the flywheel (270). The resilient stopper (282) is fixedly secured to the frame (246) or one of the vertical panels (252, 254, side panels not shown) in a position that is rotationally aligned with the stopping member (280). The resilient stopper (282) may include silicone, rubber, foam, or a spring and a plunger. The resilient stopper (282) is configured to engage the stopping member (280) to stop the resilient stopper (282) in a controlled manner in the second position to prevent the further rotation of the rotating assembly (204) and acts as a buffer to prevent the rotating assembly (204) from being damaged by engaging the housing assembly (202) directly.

Once the stopping member (280) engages the resilient stopper (282) a batting assistant may use the bat (BAT) to transition the batting device (200) from the second position back to the first position. When the rotating assembly (204) is in the first position a solenoid spring (284) extends the solenoid shaft (268) through the aperture (278) in the flywheel (270) retaining the rotating assembly (204) in the first position. Once restored to the first position, the batting device (200) is ready for the next user.

Figure 4B:
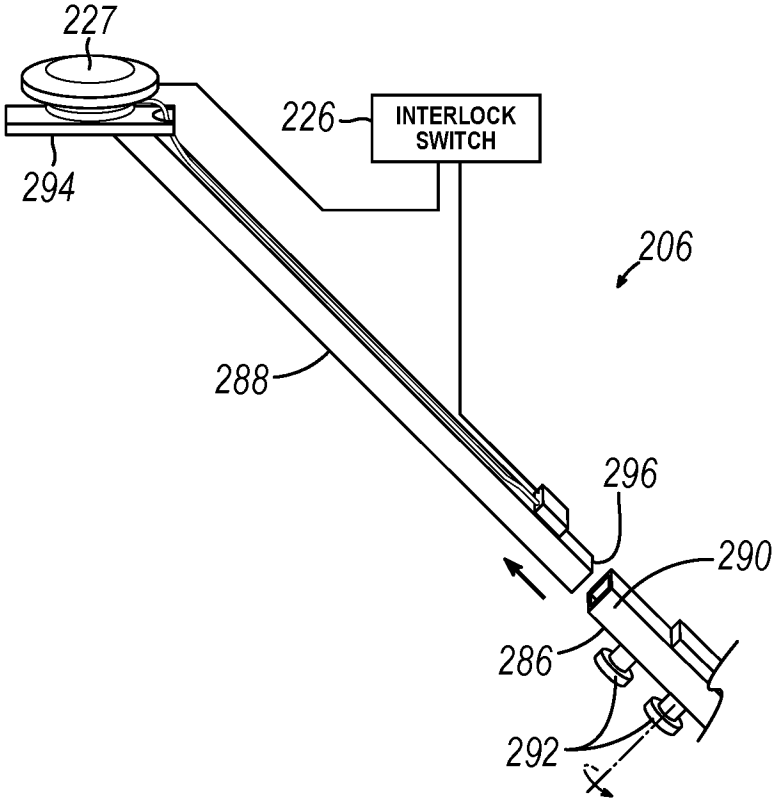
FIG. 4B shows a side perspective view a handle assembly of the batting device of FIG. 1 in a disassembled position.
Figure 4A:
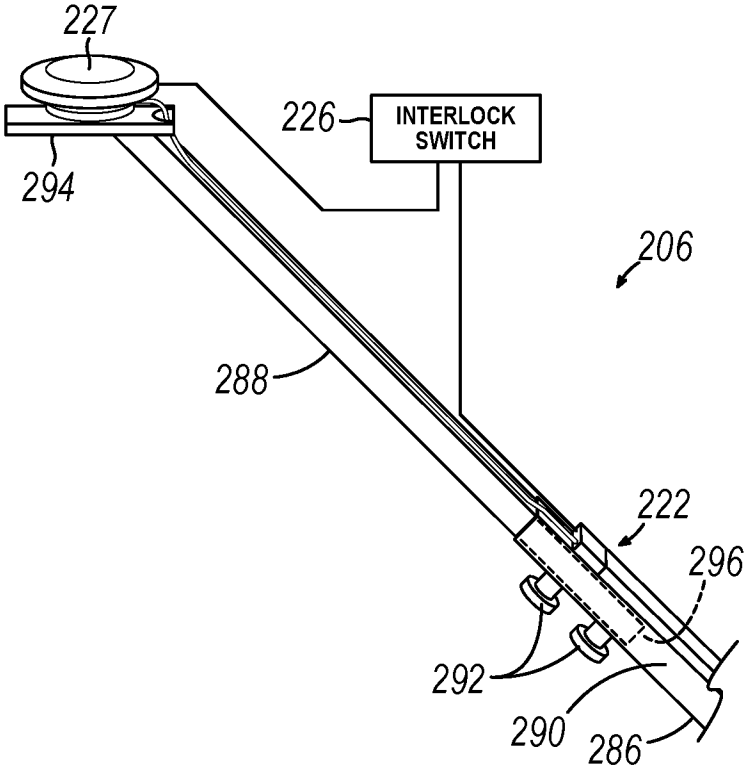
FIG. 4A shows a side perspective view of a handle assembly of the batting device of FIG. 1 in an assembled position.

FIG. 4A shows the handle assembly (206) including a lower handle (286) that is attached to an upper handle (288) in an assembled position. The lower handle (286) includes a lower handle body (290), and one or more handle retainers (292). The lower handle body (290) is attached to the lower panel (250) or frame (246) of housing assembly (202) and extends through the back panel (252) of the housing assembly (202). The one or more handle retainers (292) are positioned on the upper portion of the lower handle body (290) and are configured to retain the upper handle (288) within the lower handle (286). In the present version, the lower handle (286) includes two handle retainers (292). The handle retainers (292) are threadably affixed to the lower handle body (290) and extend through a side surface of the lower handle body (290) and engage a lower portion of the upper handle (288). The handle retainers (292) may further include a locking device (not shown) to ensure the handle retainers (292) engage the upper handle (288). The locking device may be a locking nut (not shown).

The upper handle (288) includes an upper portion (294) that is configured to retain the firing switch (227) and a lower portion (296) configured to be retained by the lower handle (286). The lower portion (296) of the upper handle body (288) is configured to fit within the lower handle (290) or vise-versa. The lower portion (296) of the upper handle (288) is configured to slide within the lower handle body (290) at various depths to adjust the height of the firing switch (277). In some versions, the upper handle may include a T-handle (not shown) that further aids a user in manipulating the batting device (200).

FIG. 4B shows the handle assembly (206) in the disassembled position with the upper handle (288) detached from the lower handle (286). The handle assembly (206) is transitioned from the assembled position to the disassembled position by disconnecting the first wiring connector (222) and unthreading the handle retainers (292), which disengages the handle retainers from the lower portion (296) of the upper handle (288). The upper handle (288) is pulled away and removed from the lower handle body (290) allowing a batting assistant to reduce the overall length of the batting device (200) during transportation to and from a sports field with a vehicle such as an automobile, SUV or truck.

Figure 5:
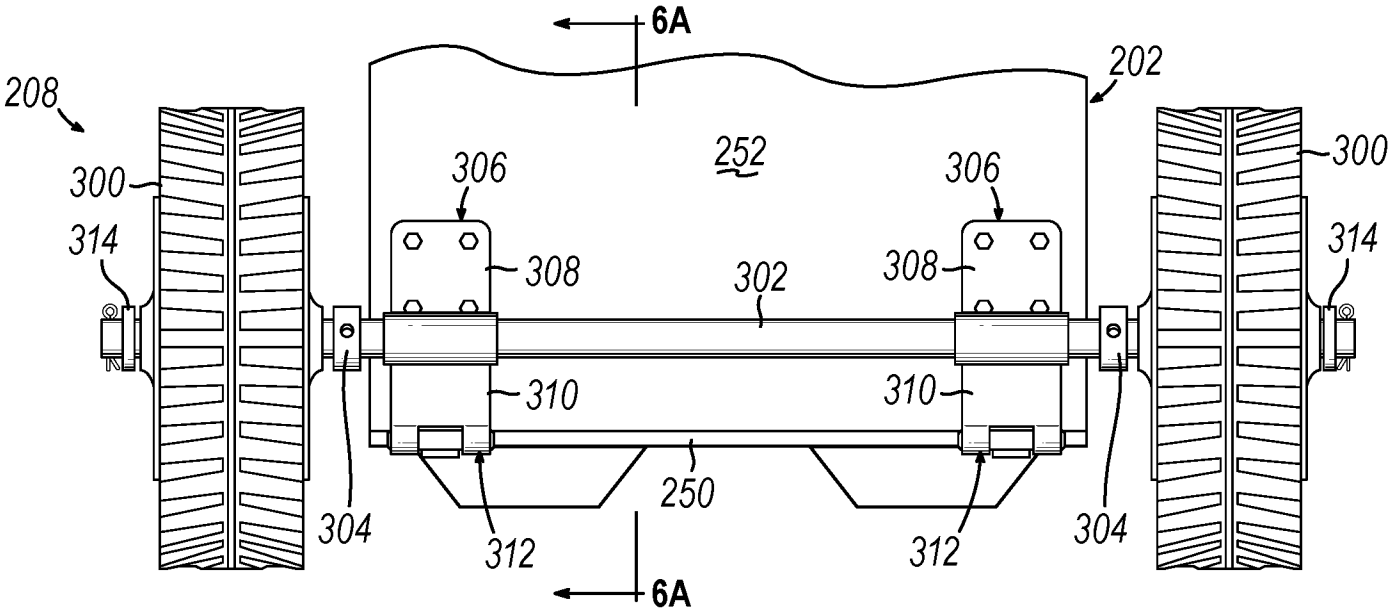
FIG. 5 shows a side perspective view of a wheel assembly of the batting device of FIG. 1 that is capable of transitioning between an immobile position and a mobile position.
Figure 6A:
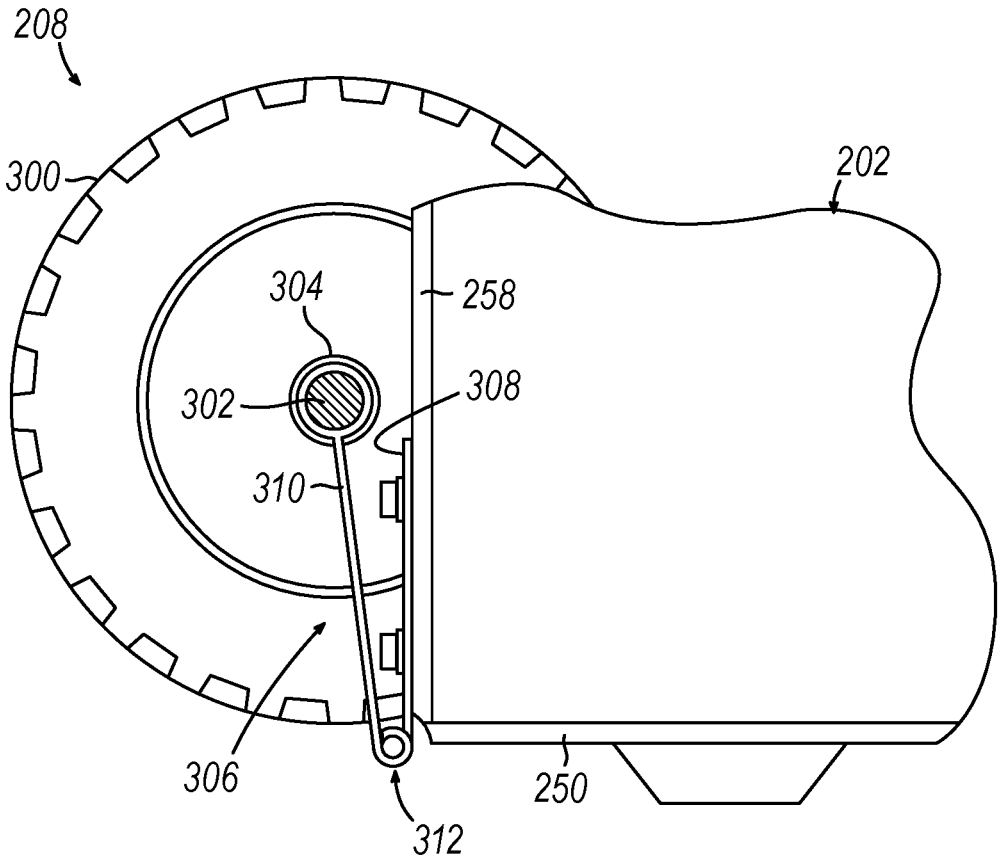
FIG. 6A shows a side perspective view of the batting device of FIG. 1 in a first, immobile position.
Figure 6B:
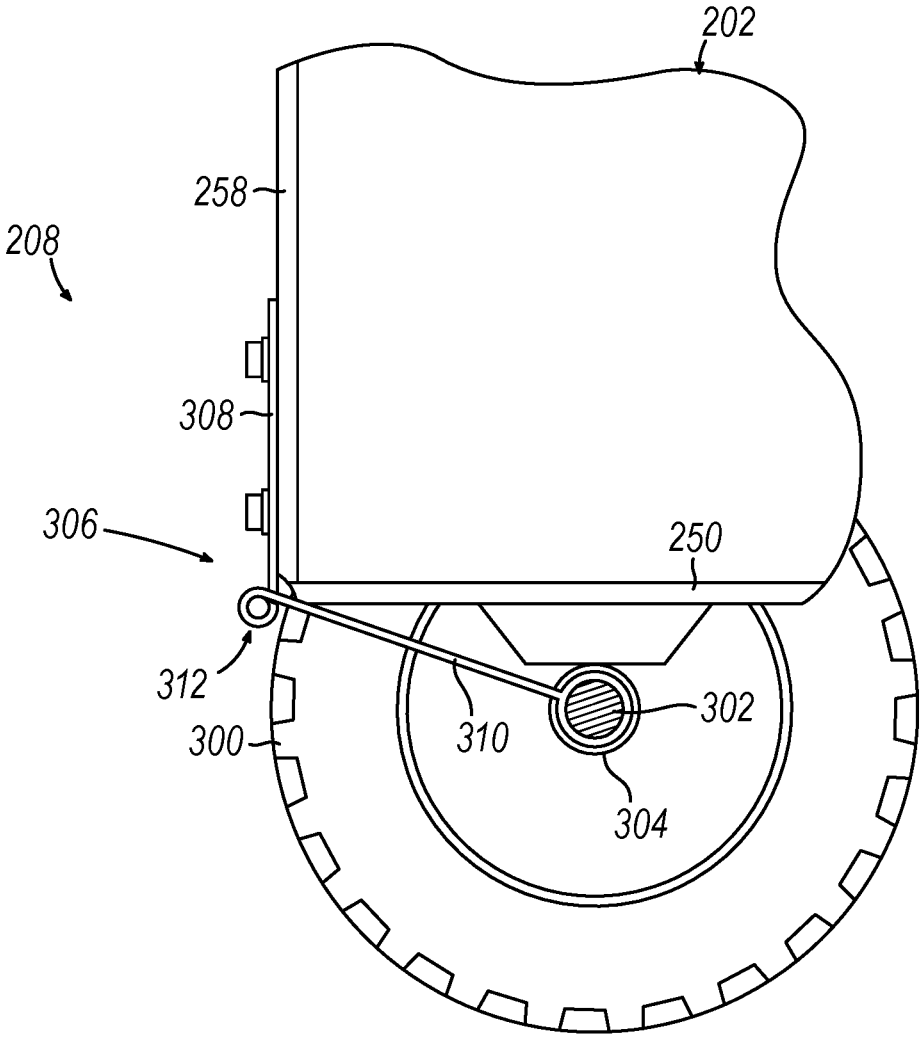
FIG. 6B shows a side perspective view the batting device of FIG. 1 in a second, mobile position.

FIG. 5-6B shows the axle assembly (208) including one or more wheels (300), an axle (302), two or more first wheel retainers (304), two or more second wheel retainers (314) and one or more hinges (306). In the present version, the one or more wheels (300) includes two wheels (300), although as little as one wheel (300) or multiple wheels (300) may be utilized. For example, three, four, five, or six wheels (300) may be utilized. The hinges (306) include a first portion (308), a second portion (310) and a pivot (312) positioned between the first and second portions (308, 310). The first portion (308) of the hinge (306) is affixed to the back panel (252) or a portion of the frame (246). The first portion (308) is mounted generally flush with the back panel (252). The first portion (308) of the hinge (306) is affixed to the back panel (252) with welding or bolting so that the first portion (308) is held static and resists flexing of the first portion (308) relative to the back panel (252). It should be noted that in addition or in the alternative, the axle assembly (208) may be positioned on the front panel (254), on one of the pair of side panels (not shown), or on the front panel (254).

The second portion (310) of the hinge (306) is affixed to the axle (302). The hinges extend parallel the side panels. The axle (302) is distally positioned upon the second portion (310) of the hinge (306) relative to the pivot (312). The pair of wheels (300) are spaced apart by a pair of first wheel retainers (304) that locate the wheels (300) a distance from one another. The first wheel retainers (304) inhibits the wheels (300) from moving towards one another and contacting the housing assembly (202). The pair of second wheel retainers (314) are positioned on the axle (302) outside of the wheels (300). The pair of second wheel retainers (314) inhibit the wheels (300) from being removed from the axle (302). The pair of wheels (300) are spaced a first distance (D1) away from each other that is greater than the width the housing assembly (202) allowing the hinge (306) to rotate towards the bottom panel (250) without the wheels (300) contacting any portion of the housing assembly (202).

FIG. 6A shows the axle assembly (208) in a first, biased position. In the first position, the second portion of the hinge is bent so that the first and second portions (308, 310) of the hinge (306) form an angle that is less than 90 degrees at the pivot (312) and the wheels (300) rest on the ground not under compression. With the hinge (306) in the first position, the actuating assembly (212) may be fired to rotate the rotating assembly, and thereby rotate the swinging assembly (210) to swing the bat (BAT) at the ball (BALL). A user may lift up the handle assembly (206) providing space to swing the second portion (310) of the hinge (306) away from beneath the housing assembly (202) so that the pair of wheels rest upon the ground behind the back panel (252). The second portion (310) of the hinge (306) is rotated about the pivot (312) by a foot or a hand of the user to the first position the housing assembly (202) is stationary. In the first position, the wheels (300) do not elevate the back panel (252) of the housing assembly (202) and the bottom panel (250) engages the ground and provides a stable mechanical ground for the batting device (200).

FIG. 6B shows the batting device (200) with the axle assembly (208) after being transitioned to a second, unbiased position. In the second position the batting device (200) becomes mobile. The handle assembly (206) is used to transport the batting device (200) by rolling the batting device (200) on the wheels (300). To transition the batting device (200) from the first position (see FIG. 6A) to the second position the handle assembly (206) is lifted to raise the back of the batting device (200) providing a space between the bottom panel (252) and the ground. The batting assistant pushes upon the axle assembly (208) with a foot or a hand so that the second portion (310) of the hinge (306) moves beneath the bottom panel (250). A portion of the second portion (310) of the hinge (306) contacts the corner of the batting device (200) where the back panel (252) joins the bottom panel (250). The hinge (306) forms an angle greater than 90 degrees, and the pair of wheels (300) raise the back panel (252) off the ground. Once in the second position, the handle assembly (206) may be tilted backwards towards the ground, which raises the forward panel (254) of the housing assembly (202). Once the batting device (200) is tilted backwards, the wheels (300) are the only portion of the batting device (200) touching the earth, which enabling a user to roll the batting device (200) by the handle assembly (206). The wheels (300) suspend the rest of the batting device (200) so that the batting device (200) may be rolled from a vehicle to the baseball field and vise-versa. Additionally, in games such as baseball, once the ball (BALL) is hit into play baserunners need to safely access the home plate. The batting device (200) must quickly be removed to allow this access.

Figure 7:
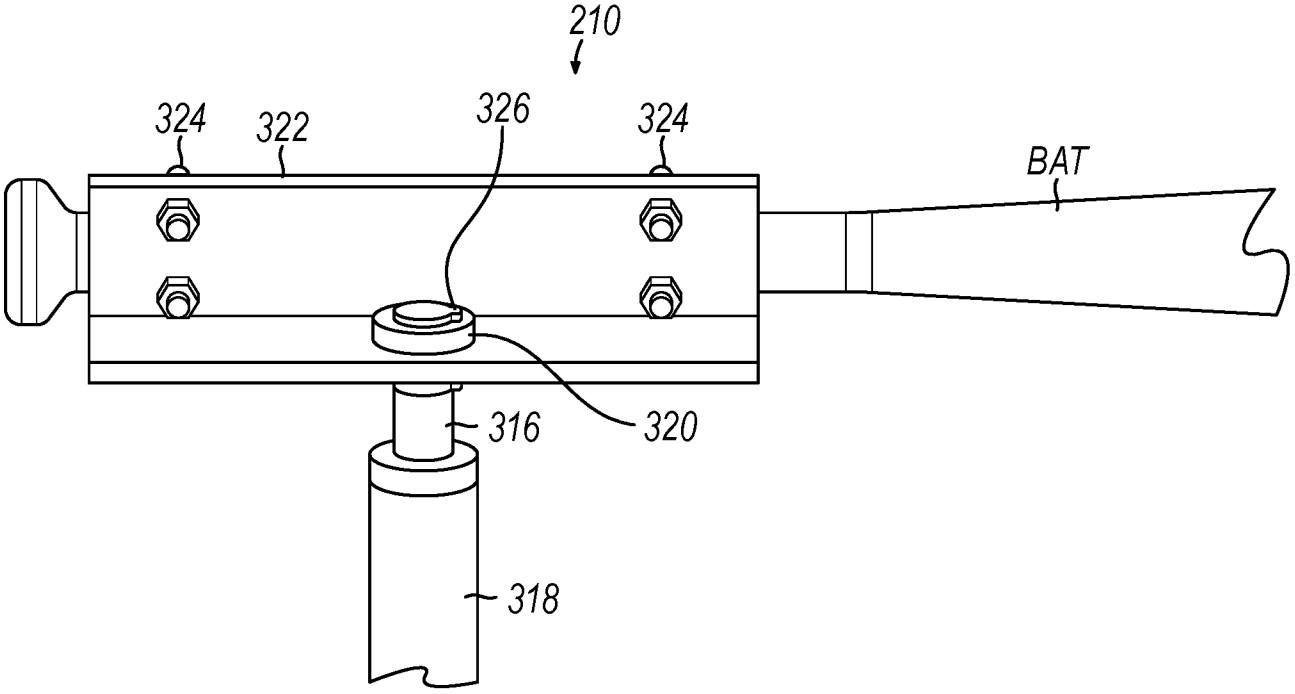
FIG. 7 shows a side perspective view of the bat swinging assembly of batting device of FIG. 1.

FIG. 7 shows the swinging assembly (210) including a swinging shaft (316) extending distally away from the housing assembly (202), a tube (318) configured to support the swinging shaft (316), a shaft retainer (320), a bat support (322), and one or more bat retainers (324). The tube (318) has bearings or bushings positioned within the tube (318) that support the swinging shaft (316) that extends distally away from the housing assembly (202). The tube (318) is fixedly attached to the top panel (248). The swinging shaft (316) is fixedly attached to the rotating assembly (204) within the interior (256) of the housing assembly (202) and extends distally away from the housing assembly (202) through the top panel (248) and tube (318) to the shaft retainer (320). The swinging shaft (316) is free to rotate within the tube (318) and the swinging shaft (316) rotates when the rotating assembly (204) rotates. It should be noted that the swinging shaft (316) may be continuous from a rotating shaft (316) of the rotating assembly (204) or may be a separate swinging shaft (316) coupled to the shaft of the rotating assembly (204) with a coupler. The shaft retainer (320) is keyed to the shaft with a key (326) or a locking bolt that maintains a rotational position of the swinging shaft (316) relative to the bat support (322). The shaft retainer (320) may also additionally include a locking bolt (not shown) that engages one of the swinging shaft (316) or the key (326) to maintain the longitudinal position of the bat support (322) relative to the swinging shaft (316).

The bat retainer (324) includes one or more U-bolts (not shown) or fastening members. In some versions, the U-bolts are replaced with a saddle including bolts extending from the saddle. The U-bolts are positioned upon the bat support (322) and are configured to be fitted around the handle of the bat (BAT) to retain the bat (BAT) against the bat support (322). The U-bolts have a continuous rod that is bent in a U-shape and includes a pair of threaded portions (330) that face one direction. The pair of threaded portions (330) are configured to extend through bores (332) in the bat support (322) and are tightened with nuts (334) to secure the bat (BAT) upon the bat support (322). The bat support (322) includes a horizontal member (336) and a vertical member (338). Both the horizontal member (336) and the vertical member (338) are planar in shape and are joined together at an angle or in the alternative the bat support (322) may be formed of angle iron having vertical and horizontal planar components. The U-bolts (328) may extend through the horizontal member (336) or the vertical member (338) of the bat support (322). The nuts (334) may have additional nuts positioned on the threaded portions (330) of the U-bolts (328) to lock the handle of the bat (BAT) to the horizontal member (336).

II. EXEMPLARY MECHANICALLY ACTUATED BATTING DEVICE

In some instances, it may be desirable to provide a batting device that may be actuated manually by a user pulling a string, a lever, or other firing device to release the rotating assembly. This provides a user with limited motor function the ability to hit a ball with a bat without having to physically wield the bat. Such a device must be stationary and stable when in operation so the device may transfer energy to the ball to enable the ball to be hit into play at an acceptable distance. The device must also be portable and compact so that the device may be easily transported to a sports field but be capable of being quickly moved so the batting device does not interfere with baserunners. The batting device described below in connection with the Figures exhibit such features and functionality.

Figure 8:
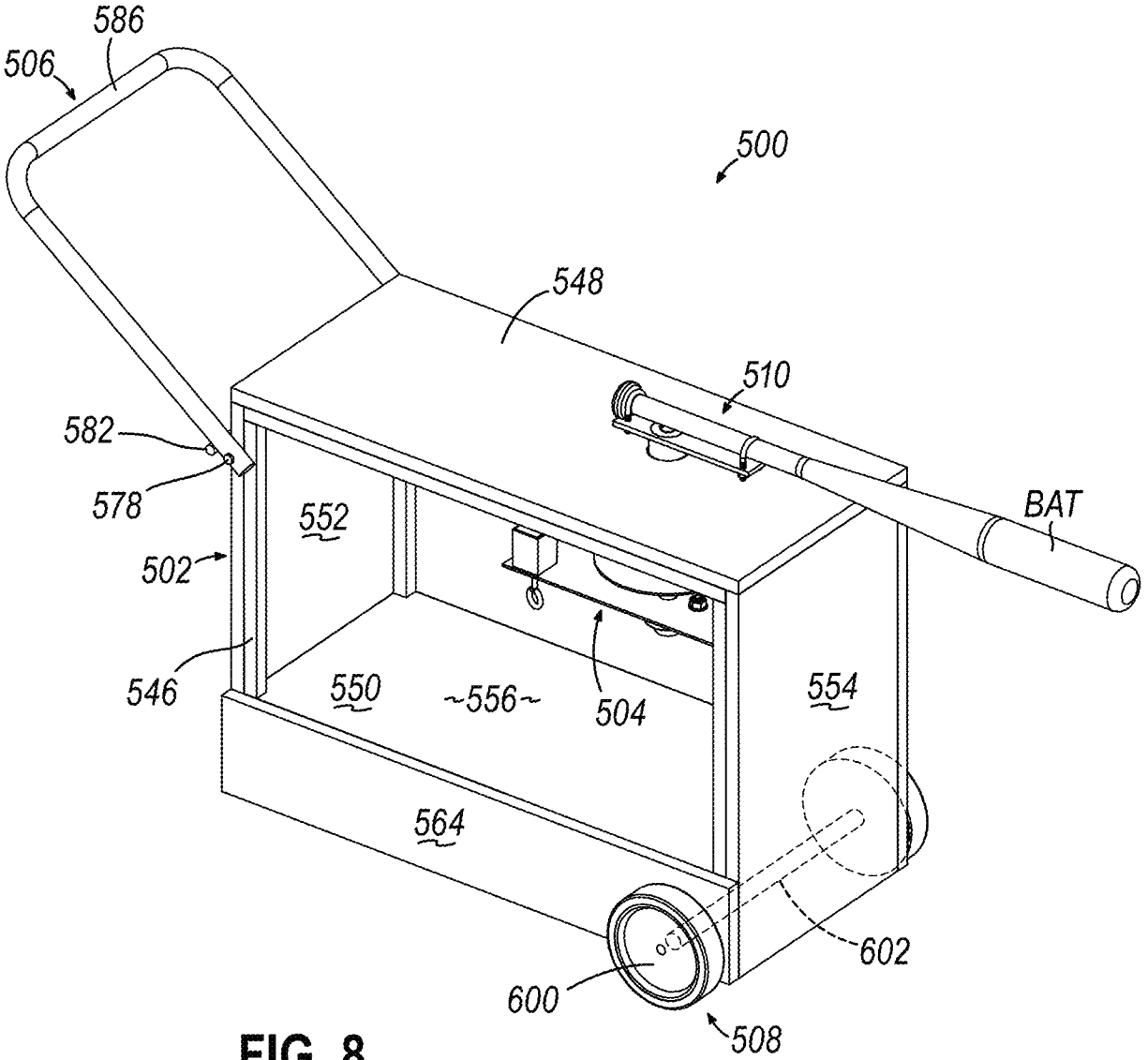
FIG. 8 shows a side perspective view of another batting device.

FIG. 8 shows another exemplary batting device (500) substantially similar to batting device (200) (300) described above, respectively, with differences elaborated below. Both batting devices include a housing assembly (502) best shown in FIG. 8, a rotating assembly (504) best shown in FIG. 9, a handle assembly (506) best shown in FIG. 8, an actuating assembly (512) best shown in FIG. 9, an axle assembly (508) best shown in FIG. 8, and a swinging assembly (510) best shown in FIG. 9. The batting device (500) differs from batting device (200) in that the handle assembly (506) is rotatably coupled to the housing, the axle assembly (508) is ruggedly constructed for simplicity, and the actuation assembly (510) is mechanically actuated rather than electrically actuated.

The housing assembly (502) includes a frame (546) a top panel (548), a bottom panel (550), a front panel (554), a back panel (552) and a pair of side panels (not shown. It should be noted that the side panels (not shown) include additional side panels (not shown) configured to enclose an interior (556) of the housing assembly (502) for safety purposes. The side panels prevent a person from reaching within the interior (556) and accessing the moving parts of the rotating assembly (504).

The handle assembly (506) includes a handle (586), a pivot (578), and a stopper (582). The handle assembly (506) is rotatably coupled to the frame (546). The handle may be unitarily formed or constructed of multiple pieces but is not configured to be dismantled during the normal transportation of the batting device (500) to and from the sports field. The handle assembly (506) at rest swings downwards away from stopper (582) in a travel configuration. The travel configuration with the handle resting vertically upon a portion of the frame reduces the overall length of the batting device (500) so that the batting device (500) may easily be transported in a car, SUV, or truck. A batting assistant transitions the handle assembly (506) to an operational configuration by pulling upwards on the handle assembly (506) when being moved until the handle exhibits force upon the stopper (582) allowing the back portion of the housing assembly (502) to be quickly lifted allowing the weight to be transferred to the axle assembly (508) facilitating movement after a ball (BALL) is hit so that the batting device (500) does not interfere with base runners running towards home plate.

The axle assembly (508) includes a pair of wheels rotatably coupled to an axle (602) that is affixed to one of the side panels or extends from a first side to a second side and extends through the side panels (not shown). The batting device (500) does not require preparation before transporting the batting device (500). A batting assistant lifts the handle assembly (506) so that the pair of wheels (600) rotatably coupled to the axle assembly (508) engage the earth allowing the batting device (500) to roll. The batting device (500) is then wheeled away by pulling upon the handle assembly (506).

Figure 9:
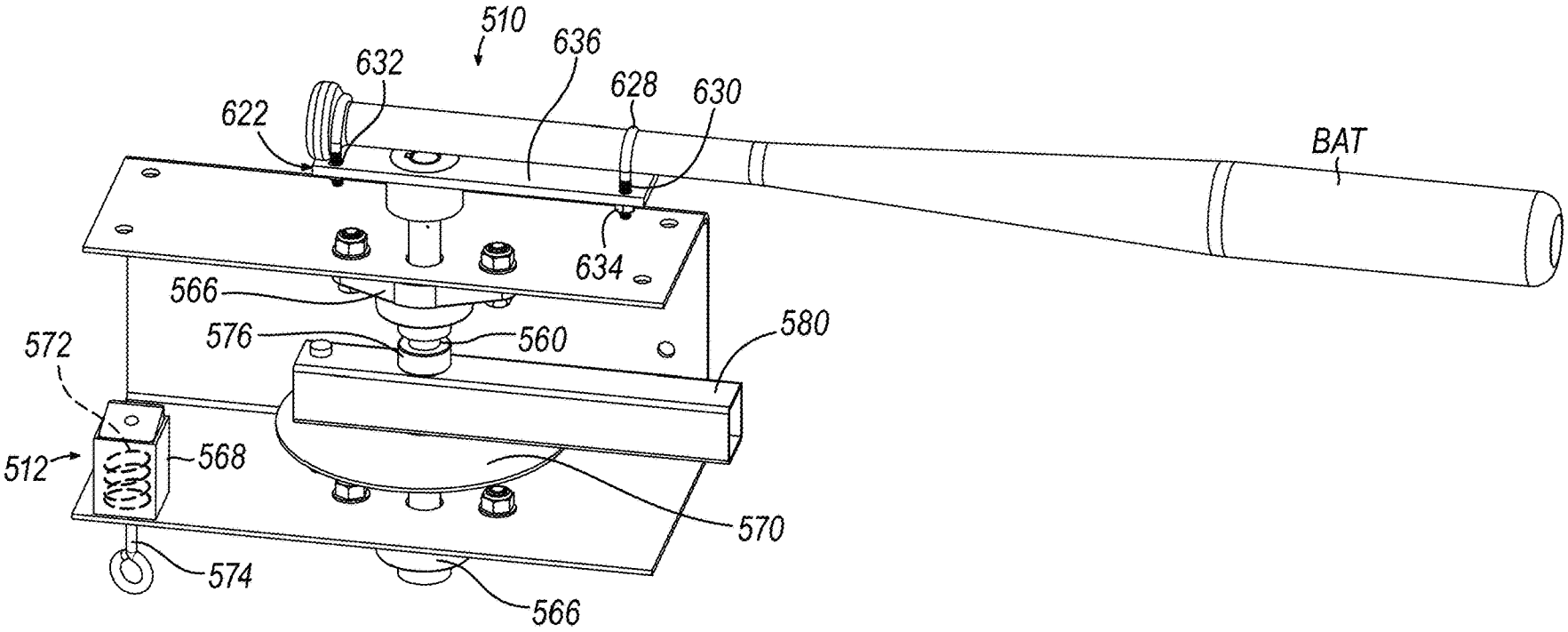
FIG. 9 shows a side perspective view of the rotating assembly, and swinging assembly of the batting device of FIG. 8.

FIG. 9 shows the rotating assembly (504), the actuating assembly (512), and the swinging assembly (510). The rotating assembly (504) includes a subframe (564), a flywheel (570), a shaft (560), a resilient member (558), an arm (580), and a pair of bearings (566). The subframe (564) is bolted to the top panel (548) or to a top portion of the frame (546). The bearings (566) are operatively attached to the subframe (564). The resilient member (558) is a spring that biases the arm (580) in a clockwise direction and is configured to exhibit rotational force on the arm. Arm (580) is bolted or welded to the flywheel (570) which is operatively attached to the shaft (560). In the alternative or in addition, one or more collars (576) may be used to attach the arm (580) and/or the flywheel (570) to the shaft (560).

The arm (580) in the first position is engaged by the actuating assembly (512). In the first position the resilient member (558) is under tension and the actuating assembly (512) resists the rotating assembly (504) from rotating in a counter-clockwise direction. The actuating assembly (512) includes an actuator body (568), an actuator spring (572), and an actuator plunger (574). The actuator plunger (574) includes an angled surface configured to engage the arm (580). At rest, the spring (572) biases the actuator plunger (574) through the actuator body (568) to an extended position and engages a side surface of the arm (580). In some versions, the arm (580) may include an aperture or a notch that enables the actuator plunger (574) to engage and retain the arm (580) in the first position. The actuating assembly (512) is transitioned to the retracted position by a string (not shown) used as a firing device that is attached to the actuator plunger (574) being pulled. Once the plunger is in the retracted position, the rotating assembly (504) swings in the counter-clockwise direction, thereby swinging the swinging assembly (510), that swings the bat that hits the ball (BALL). The shaft (560) of the rotating assembly (504) extends above the subframe (564) to the swinging assembly (510).

The swinging assembly (510) includes a collar (576) and a bat support (622). The bat support (622) is fixedly attached to the collar (576). The bat support (622) includes a horizontal member (636) and one or more U-bolts (628). The U-bolts (628) are configured to be fitted around the handle of the bat (BAT) and retain the bat (BAT) against the horizontal member (636). The U-bolts (628) extend through bores (632) in the horizontal member (636) and are tightened with nuts (634) to secure the bat (BAT) to the horizontal member (636). The nuts (634) may have additional nuts (634) on the threaded portions (630) of the U-bolts (628) to aid in retaining the bat (BAT).

III. EXEMPLARY MECHANICALLY AND ELECTRICALLY ACTUATED BATTING DEVICE

In some instances, it may be desirable to provide a batting device that may be actuated both mechanically and electrically. This provides a user with limited motor function to hit a ball with a bat from a ball holder with or without the aid of electricity. Such a device must be stationary and stable when in operation so the device may transfer energy to the ball to enable the ball to be hit into play at an acceptable distance. The device must also be portable and compact so that the device may be easily transported to a sports field but be capable of being quickly moved so the batting device does not interfere with baserunners. The batting device may also need to have variable degrees of hitting force so that the distance that a ball is hit is adjusted to the ability of the league of play. For example, with leagues with small children the ball may need to be hit a short distance from the home plate, while leagues with larger children my benefit from the ball being hit farther from the home plate. The batting device described below in connection with the Figures exhibit such features and functionality.

Figure 10:
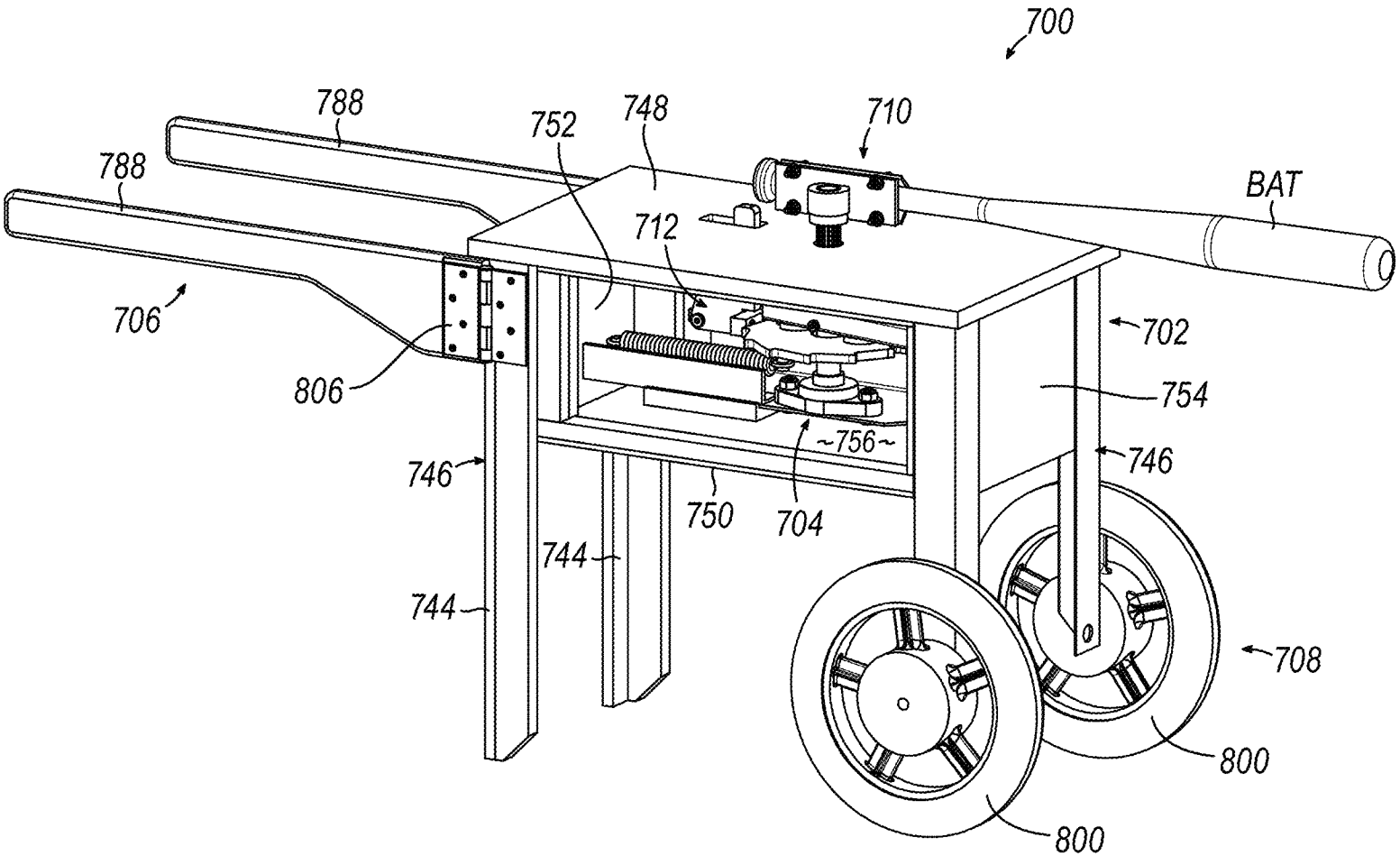
FIG. 10 shows a side perspective view of yet another batting device with a handle assembly in the unfolded position.

FIG. 10 shows another exemplary actuated batting device (700) similar to batting device (200) described above, respectively, with differences elaborated below. Both batting devices (700) include a housing assembly (702) best shown in FIG. 10-11, a handle assembly (706) best shown in FIGS. 10-11, an axle assembly (708) best shown in FIGS. 10-11, a rotating assembly (704) best shown in FIG. 12, and a swinging assembly (710) best shown in FIG. 13.

The housing assembly (702) includes a frame (746) a top panel (748), a bottom panel (750), a front panel (754), and a back panel (752) that partially enclose an interior (756). It should be noted that the housing assembly (702) also include side panels (762) removed in FIG. 10 for viewing of the internal components. The interior (756) is noticeably smaller than the interior of the batting device (200). The frame (746) extends from the bottom panel (750) with four legs (744). The four legs (744) are configured to support the housing assembly (702) at a suitable height. The axle assembly (708) includes a pair of wheels (800) that are rotatably attached to the front two legs (744).

The handle assembly (706) includes a pair of handles (788) fixedly attached to a pair of hinges (806) that are fixedly attached to the frame (746). The handle assembly (706) is shown in the unfolded position. The handle assembly (706) further includes a magnet (not shown) positioned on each of the handles (788) or the housing assembly (702) configured to retain the handle in the folded position (see FIG. 11). The batting device (700) is shown in an operational configuration. In the operation configuration the batting device (700) is able to hit a ball (BALL) and is ready to be moved with the pair of handles (788) after the ball (BALL) is hit by the batting device (700).

Figure 11:
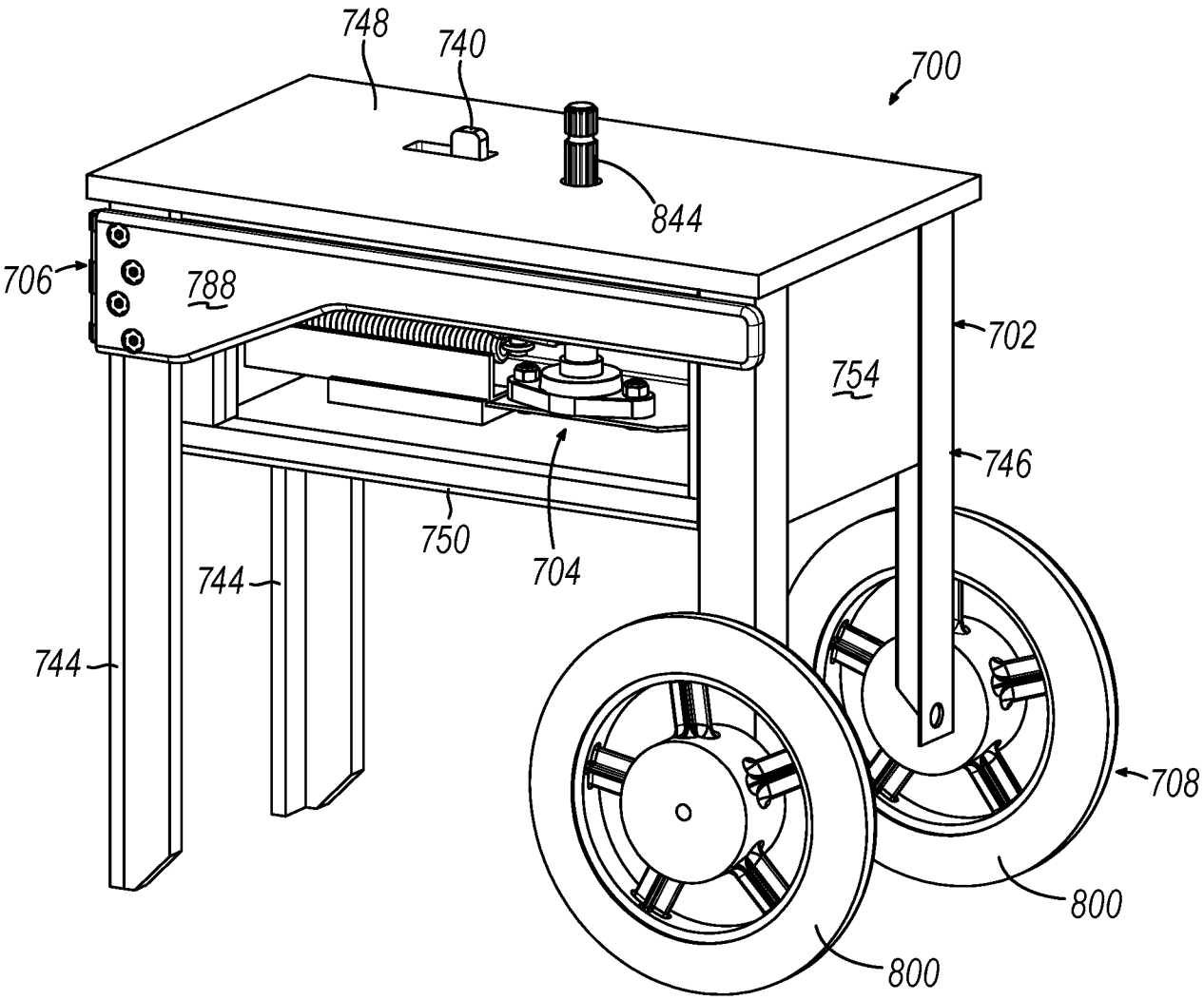
FIG. 11 shows a side perspective view of a portion of the batting device of FIG. 8 with the handle assembly in the folded position.

FIG. 11 shows a portion of the batting device (700) in a travel configuration. In the travel configuration, the handle assembly (706) is in the folded position and the swinging assembly (710) is removed. The batting device (700) in the travel configuration is compact and facilitates the batting device (700) being loaded into a vehicle such as a car, an SUV, or a truck. The swinging assembly (710) see FIG. 13 after being removed reduces the overall length of the batting device (700) and may be separately placed in the vehicle.

Figure 12:
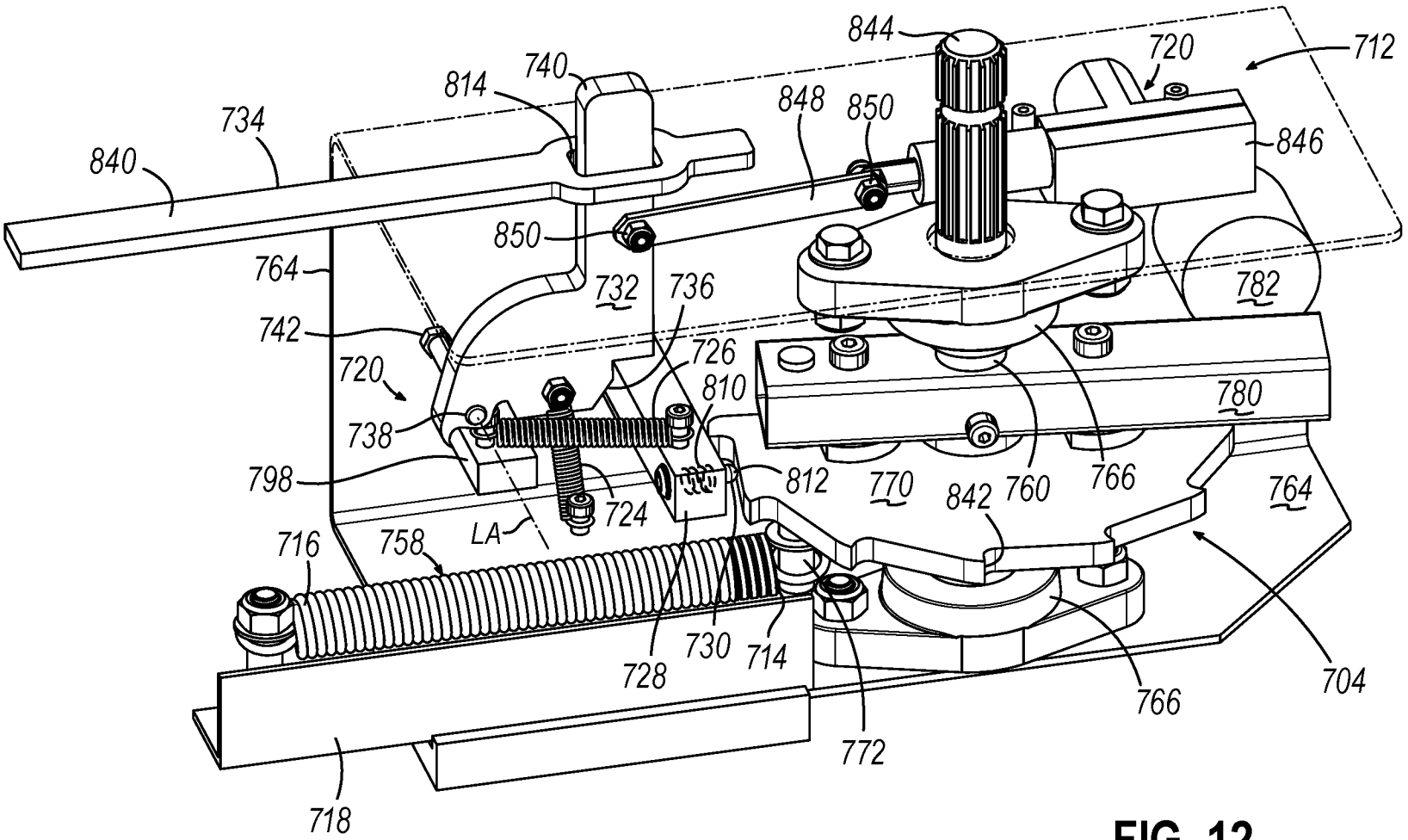
FIG. 12 shows a side perspective view of the actuating assembly and the rotating assembly housed within a subframe.

FIG. 12 shows the shows the rotating assembly (704) and the actuating assembly (712) of the batting device (700). The rotating assembly (704) includes a subframe (764), a cog (770), a shaft (760), a resilient member (758), a stopping member (780), a pair of bearings (766) and a resilient stopper (782). The subframe (764) includes a stamped piece of metal formed in a U-shape. The subframe (764) is bolted to the top panel (748) or frame (746) of the housing assembly (702). The bearings (766) are oriented vertically and operatively attached to the subframe (764) by bolts or by welding. The resilient member (758) includes a linear spring configured to bias the cog (770) in a clockwise direction as viewed from the top. The resilient member (758) includes a first end (714) and a second end (716). The first end (714) of the resilient member (758) is attached to the cog (770) via a stud (772) that extends vertically in a direction transverse to the cog (770). The stud (772) extends through both the cog (770) and the stopping member (780) and provides an attachment point for the resilient member (758). The second end (716) of the resilient member (758) is attached to an elongate extension (718) welded or bolted to the subframe (764). The elongate extension (718) provides for a longer resilient member (758). The longer resilient member (758) allows for an increase of energy transferred to the ball, allowing the ball to be hit farther. The stopping member (780) is operatively attached to the cog (770) and is configured to stop the rotating assembly (704) by engaging the stopping member (780). The stopping member (780) may be spaced away from the cog (770) by an alignment feature (not shown). The alignment feature is configured to align the stopping member (780) with the resilient stopper (782). The resilient stopper (782) may be constructed of rubber, silicone, or some other resilient material known in the art. In the alternative or in addition, one or more collars (776) may be used to attach the stopping member (780) and/or the cog (770) to the shaft (760). The cog (770) in the first position is configured to be engaged by the actuating assembly (712).

The actuating assembly (712) is configured to retain the rotating assembly (704) in a cocked, first position, and allows a user to fire the rotating assembly (704). When the rotating assembly is fired, the rotating assembly (704) is transitioned from the first position to the second position by rotating the rotating assembly (704) quickly in the counterclockwise direction. The actuating assembly (712) includes a mechanical actuation portion (712) and an electrical actuation portion (722) that are both capable of firing the rotating assembly (704) to transition the rotating assembly (704) from the first position to the second position. The electrical actuation portion (722) of the actuating assembly (712) may trigger the mechanical actuation portion (720) of the actuating assembly (712).

The mechanical actuation assembly (720) includes a first actuating spring (724), a second actuator spring (726), a pivoting bar (728), a detent member (730), a cammed lever (732), and a lever extension (734). The cammed lever (732) includes a cammed surface (736), a pin bore (738), and an elongate handle (740). The cammed lever (732) is secured to the subframe (764) by a pin (742) that extends horizontally through the pin bore (738). The pin (742) may include a mounting member (798) that fastens the pin (742) to the subframe (764) and provides a mechanical ground for the pin (742). The pin (742) and pin bore (738) allow the cammed lever (732) to rotate about a lever axis (LA) that is centered by the pin (742). The elongate handle (740) extends vertically to a length that is adequate to provide mechanical advantage to the user. The elongate handle (740) extends vertically through the subframe (764), and the top panel (748) of the housing assembly (702). The cammed surface (736) of the cammed lever (732) engages the pivoting bar (728) and provides a smooth transition to fire the rotating assembly (704) from the first position to the second position. The cammed surface (736) engages the pivoting bar (728) so that the pivoting bar (728) remains engaged with the cog (770). The first actuating spring (724) provides tension against the cam lever (732) which thereby retains the pivoting bar against the cog (770). The second actuating spring (726) provides tension in a direction that opposes the first actuating spring (726) to balance the forces that act upon the pivoting bar (728) by the first actuating spring (724) to reduce the force required to fire the actuating assembly (712). This reduction of the force to fire is important for the physically disabled that may not have the physical strength to physically fire the actuating assembly (712) otherwise. A pivoting bar (728) includes a bar pivot (not shown) that positioned on a vertical surface of the subframe (764) and the bar pivot (not shown) is arranged to allow the pivoting bar (728) to rotate within a plane that is parallel to the ground. In the present version, the second actuating spring (726) extends horizontally from the pivoting bar (728) to the mounting member (798). The second actuating spring (726) also maintains engagement between the cammed surface (736) and the pivot bar (728) for smooth operation of the actuating assembly (712).

The pivoting bar (728) is operatively mated with the detent member (730) that engages the cog (770). The detent member (730) has a detent spring (810) and a detent ball (812). The detent ball (812) retracts within the detent member (730) compressing the detent spring (810) when the rotational assembly (704) is transitioned from the second position to the first position by rotating the rotating assembly (704) in the clockwise direction. Allowing the rotating assembly (704) to be cocked without moving the cammed lever (732) and the pivoting bar (728) so that the actuating assembly (712) does not prematurely disengage the cog (770) swinging the rotating assembly (704) in the counter-clockwise direction.

The lever extension (734) allows a user to distance themselves from the actuating assembly (712) and generally the batting device (700). The lever extension (734) includes a lever bore (814) that is configured to accept the lever extension (734) and includes an elongate bar (840) that extends away from the lever bore (814) so that a user may actuate the mechanical actuation portion (720) of actuating assembly (712) without directly engaging the cammed lever (732). The lever extension (734) may include a grip (not shown) to provide a user the ability to easily grasp the lever extension (734). The cammed lever (734) may also be actuated by a string attached to the elongate handle (740).

During the actuation of the batting device (700) mechanically, the elongate handle (740) is pulled towards the user by a string or by the lever extension (734). This overcomes the force of the first actuating spring (724) while the second actuating spring (726) keeps the pivot bar (728) in engagement with the cammed surface (736) that pulls away from the cog (770) or rotational member. The detent ball (812) disengages the cog teeth (842) of the cog (770) allowing the resilient member (758) to rotate the cog (770) rotating the shaft (760), thereby rotating the external spline (844) located on the upper portion of the shaft (760). The external spline (844) rotates the swinging assembly (710).

The electrical actuation portion (722) of the actuating assembly (712) includes a solenoid (846) and an actuator bar (848). The solenoid (846) in electrical communication through the first wiring connector (222) to a control circuit (228) (see FIG. 2) having a firing switch (227) (see FIG. 2) and an interlock switch (226) (see FIG. 2). The control circuit (228) provides electrical energy to the solenoid (218). The solenoid (846) connects to the mechanical actuation portion (720) of actuating assembly (712) by the actuator bar (848). The actuator bar (848) includes a pair of actuator pins (850) positioned on both ends of the actuator bar (848) that allows for the rotational movement of the cammed lever (732) while the solenoid (846) only extends longitudinally. The first actuator pin (850) is connected to the solenoid (846) and the second actuator pin (850) is connected to the cammed lever (732). The solenoid (846) when actuated extends distally pushing actuator bar (848) rotating the cammed lever (732) firing the mechanical actuating portion (720) which rotates the swinging assembly (710).

Figure 13:
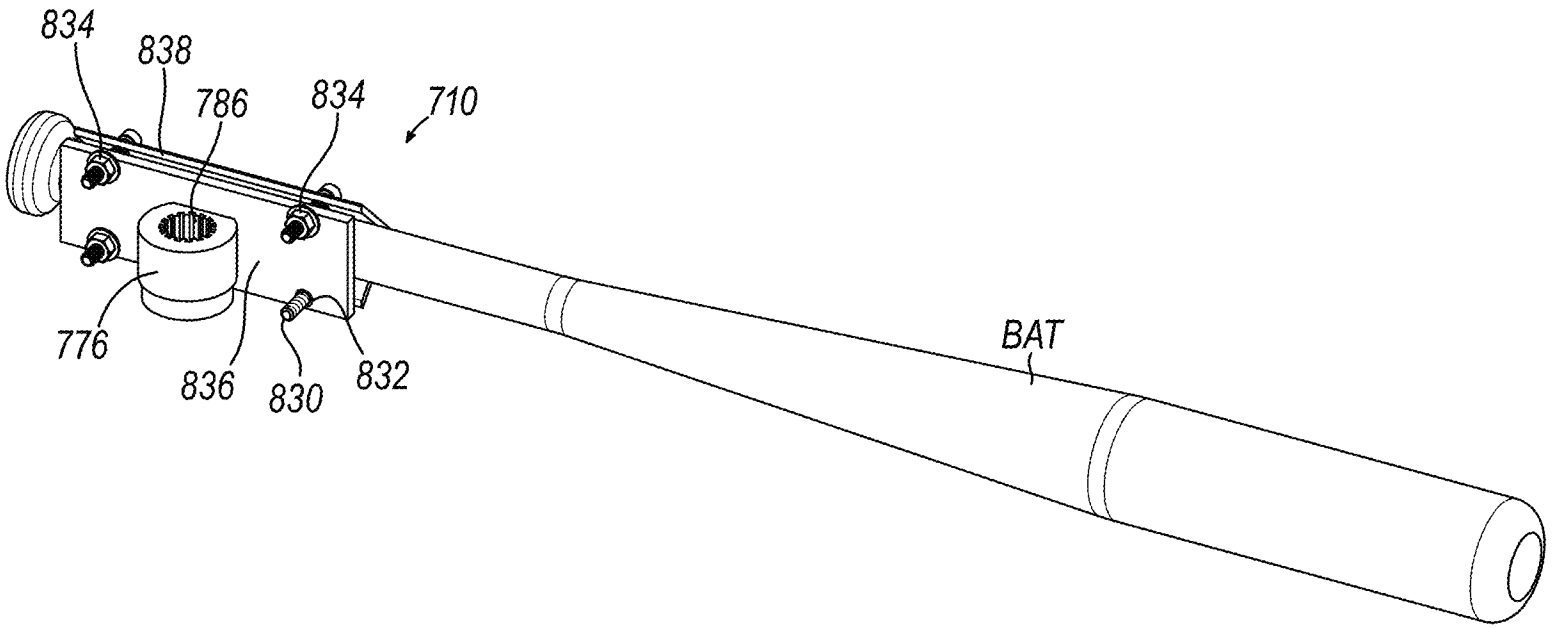
FIG. 13 shows a side perspective view of the swinging assembly coupled with a bat.

FIG. 13 shows a bat (BAT) secured to the swinging assembly (710). The swinging assembly (710) includes a collar (776) having internal splines (786) that is configured to mate with the external splines (844) of the rotating assembly (704). The collar (776) remains mated with the external splines (844) by gravitational forces. The collar (776) does not have any additional securing device. The lack of securing device facilitates easy removal of the swinging assembly (710) so that overall length of the batting device (700) may be reduced so that the batting device (700) may easily be transported. The swinging assembly (710) may be spaced apart from the top panel (748) by a spacer (not shown) so that the swinging assembly (710) does not rub on the top panel (748) or engage fasteners (not shown) that may extend past the top panel (748). In other versions, the shaft (760) may include a stopper or a quick connect fitting to prevent the collar (776) from being positioned too low performing the same function as the spacer.

The swinging assembly (710) further includes a first retainer (836) that is secured to the collar (776) by welding. The bat (BAT) is sandwiched between the first retainer (836) and the second retainer (838). The first retainer (836) is constructed of flat stock and is planar in shape, and the second retainer (838) includes an angle iron, two planar pieces of flat stock joined at a joint, or an arcuate piece of metal. The first and second retainers (836, 838) may further include a piece of rubber. A plurality of threaded rods (830) are secured to one of the first retainer (836) or the second retainer (838). The other of the first or second retainer (836, 838) includes a plurality of bores (832) configured to accept the threaded rods (830) therethrough. The threaded rods (830) are secured by nuts (834) on the other sides of the bores (832). In some versions, the threaded rods (830) may include conventional bolts that extend through bores (832) that extend through both first and second retainers (836, 838).

Figure 14A:
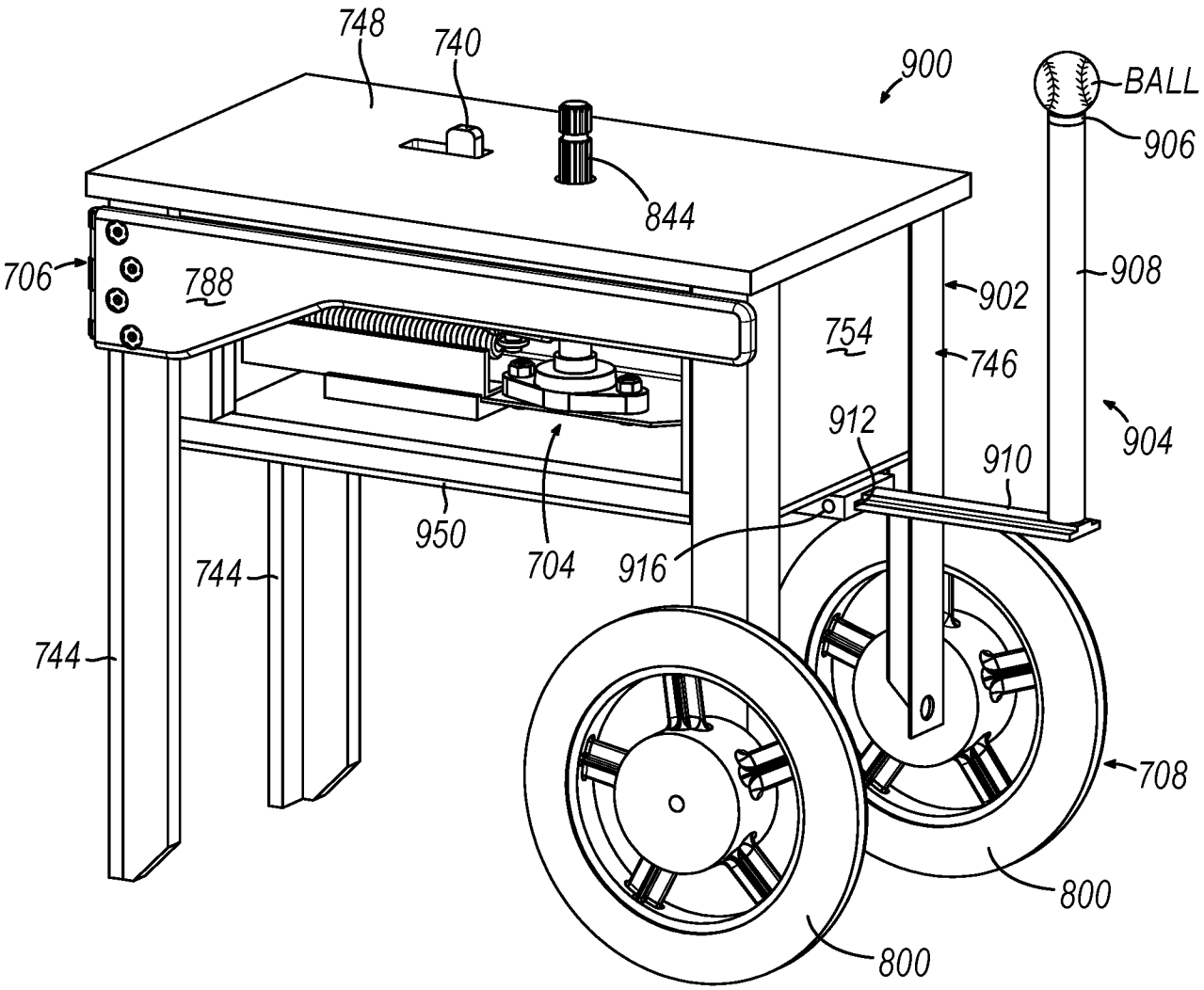
FIG. 14A shows a portion of another version of a batting device with an integrated ball holder in the extended position.

FIG. 14A shows a portion of yet another batting device (900) substantially similar to batting device (700) described above, respectively, with differences elaborated below. Both batting devices (700, 900) include a housing assembly (902), a rotating assembly (704) best shown in FIGS. 12, a handle assembly (706) best shown in FIGS. 11, an actuating assembly (712), an axle assembly (708) best shown in FIG. 11, and a swinging assembly (710) best shown in FIG. 13. The batting device (900) differs from batting device (700) in that batting device (900) includes an integrated ball holder assembly (904). The ball holder assembly (904) is shown in the extended position ready to hold a ball (BALL) at a ball height that may be hit by a bat (BAT) secured to the swinging assembly (710), as described above. The ball holder assembly (904) includes a ball holder (906), a vertical member (908), a horizontal member (910) and a channel (912). The channel (912) is positioned beneath the housing assembly (902) on the bottom panel (950). The channel (912) is fixedly attached to the bottom panel (950) by welding or bolting. The horizontal member (910) is slidably housed within the channel (912) and is configured to extend to a length suitable for connecting a ball (BALL) with a bat (BAT) positioned in the swinging assembly (710). In the alternative the horizontal member (910) may slidably engage the exterior of the channel (912) with the channel (912) being positioned within the horizontal member (910). The horizontal member (910) extends away from the housing assembly (902) in the extended position and connects to the vertical member (908) at a distal end of the horizontal member (910). The vertical member (908) extends vertically to the ball holder (906). An upper portion (914) of the vertical member (908) or the entire vertical member (908) may be configured of a resilient material such as rubber, silicone, or plastic. The resilient material to prevent damages to the vertical member (908) or the bat (BAT) when the bat (BAT) inadvertently hits the vertical member (908). The horizontal member (910) may include a stop member (916) configured to allow the ball holder assembly (904) to be extended to a predetermined distance from the housing assembly (902) so that the ball (BALL) may be optimally hit by the bat (BAT) when rotated by the swinging assembly (710). The stop member (916) may include a bolt or stud that is positioned within a slot (not shown) that terminates to prevent the ball holder assembly from completely pulling out of the channel (912).

Figure 14B:
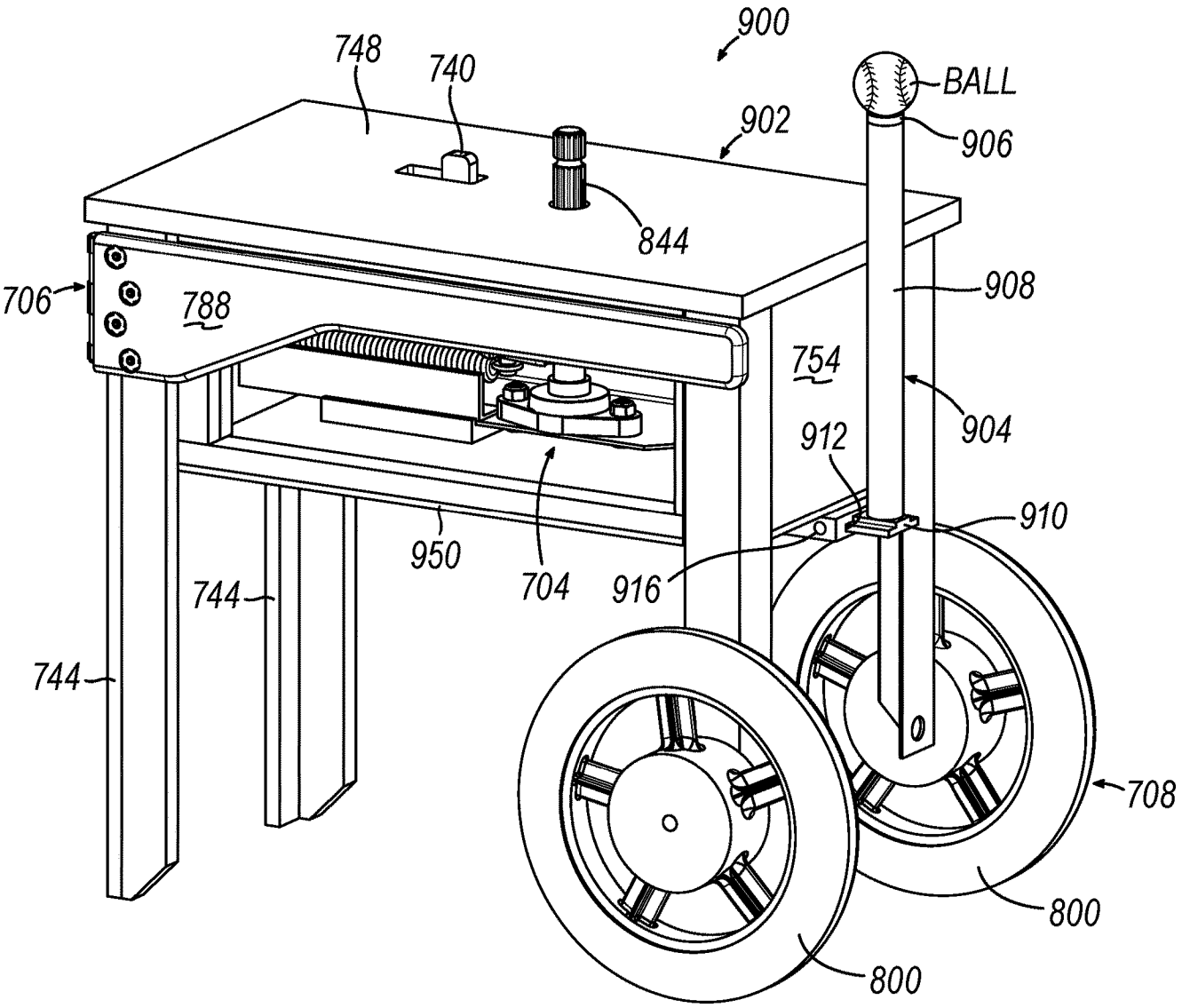
FIG. 14B shows the portion of the batting device of FIG. 14A with the integrated ball holder in the retracted position.

FIG. 14B shows the batting device (900) with the ball holder assembly (904) in the retracted position. The ball holder assembly (904) is transitioned from the extended position to the retracted position (see FIG. 14B) by a user pushing on the ball holder assembly (904) in a direction towards the housing assembly (902). The horizontal member (910) extends through the channel (912) until the vertical member (908) engages the front panel (754) of the housing assembly (902). In some versions, the ball holder assembly (904) may include one or more hinges (not shown) configured to retract the ball holder assembly (904) and reduce the overall length of the housing assembly (902). The hinges may further include a locking mechanism (not shown) to retain the ball holder assembly (904) in a position where the ball holder (906) holds a ball (BALL) within a plane that the bat (BAT) contacts the ball (BALL) held by the ball holder (906).

II. MISCELLANEOUS

It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

We claim:

1. A batting device, comprising:

(a) a housing;

(b) a rotating assembly including:

(i) a rotational member rotatably positioned within the housing, and (ii) a resilient member configured to exhibit rotational force upon the rotating assembly;

(c) an actuating assembly including a firing device configured to be acted upon by a user to transition the rotating assembly from a first state of rest to a second state of rotational movement; and (d) a swinging assembly, wherein the swinging assembly is configured to retain a bat, wherein the swinging assembly is fixedly coupled to the rotating assembly, wherein the swinging assembly rotates with the rotating assembly to swing the bat when the firing device is acted upon by the user when transitioning from the first state to the second state.

2. The batting device of claim 1, wherein the actuating assembly includes:

(i) an actuator configured to transition from a first position to a second position, (ii) a firing switch configured to transition the rotating assembly from the first position to the second position, and (iii) a wiring assembly in electrical communication between the actuator and the firing switch.

3. The batting device of claim 2, wherein the housing is coupled to a handle assembly including an upper handle and a lower handle, wherein the upper handle is removably attached to the lower handle.

4. The batting device of claim 3, wherein the wiring assembly includes a connector, an upper wiring assembly, and a lower wiring assembly, wherein the upper wiring assembly is removably connected to the lower wiring assembly by the connector.

5. The batting device of claim 1, wherein the swinging assembly includes a shaft extending distally from the housing to a bat retaining member having one or more fastening members configured to horizontally retain the bat at a first height, wherein the first height corresponds with a height of a ball on a ball holder.

6. A batting system comprising:

(a) the batting device of claim 1, and (b) a ball holder integrated within the batting device configured to hold a ball at a first height.

7. The batting device of claim 1, wherein the rotating assembly further includes one or more bearings positioned between the housing and the rotational member, wherein the bearings are configured to allow the rotational member to rotate about a batting axis.

8. The batting device of claim 1, wherein the rotating assembly further includes a stopping assembly configured to prevent further rotation of the rotational member.

9. The batting device of claim 8, wherein the stopping assembly includes a stopping member affixed to the rotational member and a resilient stopper configured to stop the rotation of the rotational member in a controlled manner.

10. The batting device of claim 2, wherein the actuator of the actuating assembly includes a solenoid.

11. The batting device of claim 2, wherein the actuating assembly includes an interlock switch positioned along the wiring assembly between the firing switch and the actuator, wherein the interlock switch is in electrical communication with the firing switch and the actuator, wherein the interlock switch prohibits communication between the firing switch and the actuator and when an operator renders the interlock switch in a closed position the interlock switch provides electrical communication between the firing switch and the actuator.

12. The batting device of claim 2, wherein the firing switch includes a jellybean switch.

13. The batting device of claim 2, wherein the firing switch includes a mouth switch.

14. The batting device of claim 10, wherein the actuating assembly includes a battery configured to provide power for actuating the actuator.

15. The batting device of claim 2, wherein the rotating assembly includes a cog configured to retain the rotating assembly in the first position.

16. A batting device, comprising:

(a) A base, including:

(i) a frame configured to provide a mechanical ground, (ii) an interior positioned within the frame, and (ii) one or more panels configured to enclose the interior;

(b) a rotating assembly, including:

(i) a shaft extending vertically, (ii) a rotational member rotatably positioned within the interior, (iii) a resilient member biasing the rotational member in a first direction of rotation, and (iv) an actuator configured to retain the rotational member in a biased position and release the actuator in an unbiased position;

(c) a swinging assembly positioned at a distal end of the shaft and configured to retain a handle of a bat; and (d) A handle assembly fixedly attached to the base.

17. The batting device of claim 16, wherein the handle assembly further includes a lower handle fixedly coupled to the frame at an angle, an upper handle removably coupled to the lower handle, and a button positioned on the upper handle, wherein the button controls the actuator.

18. The batting device of claim 16, further including (a) an axle assembly, including:

(i) one or more hinges rotatably coupled to the base;

(ii) an axle fixedly coupled to the one or more hinges; and (iii) one or more wheels rotatably coupled to the shaft, wherein the axle assembly in a first position is configured to allow the base to sit securely on a bottom panel of the base, and in a second position is configured to allow a user to transport the batting device by tilting and pulling the handle.

19. A batting device, comprising:

(a) a rotating assembly, including:

(i) a holder configured to hold a bat at a height that corresponds with a height of a ball positioned in a ball holder, (ii) a resilient member configured to exhibit rotational force upon the holder, and (iii) a release having a first position and a second position, wherein the release in the first position is configured to prevent the resilient member from rotating the holder, and the release in the second position is configured to allow the holder to rotate so that the bat may hit the ball.

20. The batting device of claim 19, wherein the release includes a battery, a switch, and a solenoid.

* * * * *